US011110566B2

(12) United States Patent
Curran et al.

(10) Patent No.: US 11,110,566 B2
(45) Date of Patent: Sep. 7, 2021

(54) DEVICE, SYSTEM, AND METHOD FOR CLEANING THE INTERIOR OF THE TUBES IN AIR-COOLED HEAT EXCHANGERS

(71) Applicants: Edward Lawrence Curran, Houston, TX (US); Jason Farrell Kolman, El Lago, TX (US)

(72) Inventors: Edward Lawrence Curran, Houston, TX (US); Jason Farrell Kolman, El Lago, TX (US)

( * ) Notice: Subject to any disclaimer, the term of this patent is extended or adjusted under 35 U.S.C. 154(b) by 291 days.

(21) Appl. No.: 16/350,134

(22) Filed: Oct. 2, 2018

(65) Prior Publication Data

US 2019/0039209 A1 Feb. 7, 2019

(51) Int. Cl.

| | |
|---|---|
| ***B24C 3/32*** | (2006.01) |
| ***B24C 5/04*** | (2006.01) |
| ***F28G 15/04*** | (2006.01) |
| ***F28G 1/16*** | (2006.01) |
| ***F28G 9/00*** | (2006.01) |
| ***B24C 7/00*** | (2006.01) |
| ***F28G 1/12*** | (2006.01) |

(52) U.S. Cl.

CPC ..... *B24C 3/325* (2013.01); *B24C 3/327* (2013.01); *B24C 5/04* (2013.01); *B24C 7/0046* (2013.01); *F28G 1/12* (2013.01); *F28G 1/163* (2013.01); *F28G 9/00* (2013.01); *F28G 15/04* (2013.01)

(58) Field of Classification Search

CPC . F28G 1/163; F28G 1/12; F28G 15/04; F28G 9/00; B24C 5/08; B24C 5/04; B24C 7/0046; B24C 3/327; B24C 3/22; B24C 3/325

USPC ..... 165/95

See application file for complete search history.

(56) References Cited

U.S. PATENT DOCUMENTS

| | | | | |
|---|---|---|---|---|
| 3,139,704 A * | 7/1964 | McCune | B08B 9/057 | 451/76 |
| 3,448,477 A * | 6/1969 | Mior | F28G 15/00 | 15/104.095 |
| 5,800,246 A * | 9/1998 | Tomioka | B24C 7/0046 | 451/2 |
| 2002/0130140 A1* | 9/2002 | Cote | B67D 3/0019 | 222/129.1 |

(Continued)

FOREIGN PATENT DOCUMENTS

| | | | | |
|---|---|---|---|---|
| JP | 60006354 A * | 1/1985 | B24C 3/327 | |
| JP | 62162900 A * | 7/1987 | F28G 1/163 | |

*Primary Examiner* — Tho V Duong

(74) *Attorney, Agent, or Firm* — David W. Alexander

(57) ABSTRACT

A device and system are disclosed to clean the interior of tubes in air-cooled heat exchangers. The device is attached at each end of a tube by electromagnetism; either directly to a ferromagnetic tube header, or to a ferromagnetic plate secured to a non-ferromagnetic plug-type header or to a plate-type header of any metal. High pressure air with entrained dry finely-divided abrasive is conducted through a nozzle supported by the device. At the other end of the tube, another device supports a nozzle that captures the air, spent abrasive, and removed material. Spent abrasive and removed material are separated by filtration from the air before the air is exhausted to the environment. Tubes are cleaned to a bright metal condition, suitable for inspection or application of a corrosion-resistant coating, or to a lesser level of cleanliness appropriate for return to service.

10 Claims, 9 Drawing Sheets

(56) References Cited

U.S. PATENT DOCUMENTS

| | | | | |
|---|---|---|---|---|
| 2004/0035445 | A1* | 2/2004 | Saxon | B08B 9/055 134/8 |
| 2011/0155174 | A1* | 6/2011 | Moll | B08B 9/027 134/8 |
| 2014/0251383 | A1* | 9/2014 | Lyle | B08B 9/0323 134/22.12 |

* cited by examiner

DEVICE, SYSTEM, AND METHOD FOR CLEANING THE INTERIOR OF THE TUBES IN AIR-COOLED HEAT EXCHANGERS

CROSS-REFERENCES RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

REFERENCE TO A "SEQUENCE LISTING."

Not applicable.

STATEMENT REGARDING PRIOR DISCLOSURES BY THE INVENTOR OR A JOINT INVENTOR

Not applicable.

BACKGROUND OF THE INVENTION

Field of the Invention

This invention relates to a device, system, and method for cleaning the interior of the tubes in air-cooled heat exchangers.

This invention further relates to a cleaning method that uses dry abrasive blasted through the tube using high pressure air to remove any accumulation in the tube or on the tube walls resulting in a bright metal finish suitable for inspection or coating or a predetermined level of cleanliness for return to service.

This invention still further relates to a device that is electromagnetically secured to the outside of a tube header to temporarily secure a grit-resistant nozzle assembly and position the nozzle for proper application of the air and entrained abrasive to facilitate cleaning, avoid tube damage, and provide for operator safety.

This invention still further relates to closed systems for cleaning the interior of the tubes with dry abrasive blasting using high pressure air, capturing the air, spent abrasive, and removed material, at the other end of the tube, separating the abrasive and removed material from the waste air, filtering the waste air, and then exhausting the filtered air to the environment; all without fugitive emissions.

The Current State of the Art

Numerous types of heat exchangers are used in the chemical process industry. Among the more common types are shell-and-tube exchangers, plate-type heat exchangers, scraped-surface heat exchangers, and air-cooled heat exchangers. Among heat exchangers, the air-cooled heat exchanger is unique since it cools a liquid or condenses a vapor using induced-draft or forced-draft ambient air. The thermal energy contained in the tube-side liquid or condensing vapor is rejected directly to ambient air.

Increased use of air-cooled heat exchangers has resulted from ever diminishing cooling water, significant increases in water costs, concern for water pollution, and in cold climates the unlimited supply of cool air. The typical air-cooled heat exchanger includes a tube bundle, with tubes which have spiral-wound fins fixed to their outsides, and a fan to move air across the tubes.

An air-cooled heat exchanger typically has greater heat transfer surface area than its liquid-liquid counterpart. They can have large foot-prints and are generally elevated to provide room for the forced-draft fans and motors; which are located underneath the tubes. FIG. 6 shows a typical forced-draft air-cooled heat exchanger with motor-driven fans, and permanent stairs and landings for access to both ends of the tubes.

The tubes in an air-cooled heat exchanger are usually arranged in a bundle of some 20-30 tubes. Numerous tube bundles may be assembled to create air-cooled heat exchangers of enormous size.

A complete tube bundle is an assembly of finned tubes, inlet and outlet headers, side frames, and tube supports. There are generally two types of headers; plug-type and plate-type. FIGS. 7 and 7A show a simple plug-type header and FIGS. 8 and 8A a simple plate-type header.

Tubes and headers wetted by the process fluid may be made out of ferromagnetic or non-ferromagnetic materials. Non-ferromagnetic materials include aluminum and aluminum alloys, stainless steels of numerous compositions, titanium, hastelloy®, brass, bronze, monel®, and other alloys that do not contain iron in appreciable amounts. Ferromagnetic materials are typically carbon steels and high nickel alloys.

Most tubes in air-cooled heat exchangers in use in the chemical process industry are 1 inch, 1¼ inch, or 1½ inch outside diameter. Tube wall thickness is based on the material of construction, the design pressure and temperature of the tube-side fluid, and the corrosion characteristics of the process fluid. Fins are almost always aluminum.

The tube-side and fin-side of the tubes in an air-cooled heat exchanger predictably foul over their life. The fouling mechanisms encountered in the tube-side are the same as those found in all heat exchangers; deposition of insoluble matter; corrosion, biological growth, crystallization, side reaction products, freezing, or a combination of one or more of them. Fin-side fouling in air-cooled heat exchangers occurs from air-borne contaminants such as dirt, dust, debris, pollen, leaves, insect accumulations, and bird carcasses. The fin-side is typically cleaned by flushing with compressed air or water under moderate pressure.

The most common method of cleaning the tube-side of air-cooled heat exchanger tubes is mechanical cleaning. For safety, most, if not all, tube-side mechanical cleaning is performed during maintenance turn-arounds with the air-cooled heat exchanger off-line, tubes purged of process fluid and prepared for cleaning, headers flushed and blanked, and all rotating equipment locked out from sources of energy.

Mechanical cleaning removes tube-side fouling by physical means. The most common methods are; (1) pulling brushes through the tube, (2) high pressure water jet cleaning, (3) high pressure air blasting without abrasive, or (4) a mix of high pressure air and finely divided abrasive to scour the inside of the tube wall. Cleaning methods that involve pulling brushes through the tube and using high pressure air without abrasive do not clean the tube to near new condition. Using high pressure water jet cleaning results in substantial amounts of waste water that must be disposed of. In cold climates, outdoor water use results in ice that creates safety issues both for its weight and its near frictionless surface. Other than the mix of high pressure air and finely divided abrasive, none of the other mechanical cleaning methods result in tubes cleaned to near new or bright metal condition. This condition is necessary if the inside of the tube is to be inspected using the Internal Rotary Inspection System (IRIS) or coated after cleaning. A valid IRIS inspection can only be performed if the tubes are cleaned to a bright metal finish. The same level of cleaning is required if the tubes are to be coated with a corrosion-resistant material.

In this invention, the mechanical cleaning method is a mix of high pressure air and finely divided abrasive. In this disclosure, finely divided abrasive and grit mean the same thing and are used interchangeably. The most commonly used abrasive is garnet. Garnet for dry blasting is typically available in sizes ranging from 16 to 80 mesh, nominal 177 to 1190 microns with a Mohs' Hardness of 6.5 to 8.5. The preferred size range for cleaning tubes in air-cooled heat exchangers is 30 to 60 mesh, nominal 250 to 595 microns, and Mohs' Hardness of 7.5 to 8. Other materials such as steel shot may also be used. The air pressure ranges from 100 to 150 pounds per square inch gauge (PSIG), with a preferred pressure of 125 PSIG. The quantity of supplied air is 350 to 400 actual cubic feet per minute (ACFM), with a preferred amount of 375 ACFM. Abrasive loading ranges from 1 to 10 pounds (LBS) per 100 actual supplied cubic feet (ASCF) at 125 PSIG, with a preferred amount of about 3 LBS per 100 ASCF at 125 PSIG.

Although this method overcomes the limitations of other mechanical cleaning methods, issues of waste disposal and safety have arisen. For safety and environmental considerations, the high pressure abrasive tube-cleaning method described here is conducted in a closed system in which there are no fugitive emissions. In the closed system, two workers are required to be on the landing shown in FIG. 6; one at each end of the tubes. One worker is positioned on the landing with a grit-resistant nozzle positioned in the center of one of the tubes to be cleaned. The supplied high pressure air with entrained abrasive is directed though the grit-resistant nozzle held by the first worker into the tube at a preselected pressure, and type and concentration of abrasive. The time required to clean a tube may range from 10 seconds to 10 minutes. At the other end of the tube, the second worker, holding an identical grit-resistant nozzle, captures the waste air, spent abrasive, and other materials ejected from the tube. The waste air, spent abrasive, and removed fouling material are directed through hoses to a drum to grossly separate any large particulate matter from the waste air stream. The waste air is then directed to a dust collection system outfitted with filter media having a nominal Minimum Efficiency Reporting Value (MERV) of no less than 14. In this disclosure, MERV refers to filter media that has been certified as meeting the filter performance requirements described in Standard 52.2-2007 of the American Society of Heating, Refrigerating and Air-Conditioning Engineers (ASHRAE). After dust collection, the filtered air is exhausted to the atmosphere.

In most instances, the workers at each end of a tube cannot see each other and sometimes find themselves positioning their nozzles on different tubes. If this occurs, the worker capturing the waste air, abrasive, and removed fouling material, can be seriously injured by being hit by the spent abrasive ejected at high velocity.

The invention described herein eliminates the need for workers to manually hold their grit-resistant nozzles while tube cleaning. The invention describes a device which holds the grit-resistant nozzles in place, a system for cleaning the inside of air-cooled heat exchanger tubes using the device, and a method for cleaning the tubes utilizing the device and system.

While the prior art discloses numerous devices, systems, and methods for cleaning heat exchanger tubes, there has been no motivation or suggestion in the art for an electromagnetic grit-resistant nozzle support and a system and method for using it.

Although there are many devices, systems, and methods for cleaning the inside of tubes in air-cooled heat exchangers, there is a need in the art for increased environmental protection and operator safety.

DESCRIPTION OF THE RELATED ART INCLUDING INFORMATION DISCLOSED UNDER 37 C.F.R. 1.97 AND 1.98

Although U.S. patents and published patent applications are known which disclose various devices, systems, and methods for cleaning the interior of air-cooled heat exchanger tubes, none of them disclose using electromagnetically attached and positioned grit-resistant nozzles to clean such tubes using high pressure air with entrained finely divided abrasive. No prior art anticipates, nor in combination renders obvious, the invention described herein.

U.S. Pat. No. 5,897,456, Curran, E., discloses a tube coating system that can be converted to an assembly for sandblasting or hydro-blasting to clean the inner wall surfaces of heat exchanger tubes by removing deposits and corrosive blisters. The invention described in Curran neither anticipates nor, when combined with other prior art, renders obvious the invention described herein.

U.S. Pat. No. 5,375,378, Rooney, J., discloses a method and devices for hydro-blasting using a hydrolyzed solution of a silica compound and water, the hydrolyzed solution containing solid particles of the silica compound, is ejected at the surface to be cleaned. Rooney further discloses that process may be employed for cleaning a variety of surfaces including the inside surfaces of tubes and heat exchangers. The invention described in Rooney neither anticipates nor, when combined with other prior art, renders obvious the invention described herein.

BRIEF SUMMARY OF THE INVENTION

It is an object of this invention to disclose a device, system, and method that, safely, efficiently, economically, and protective of the environment, cleans the inside of the tubes in air-cooled heat exchangers using high pressure air with entrained finely divided abrasive, captures the waste air, spent abrasive, and removed fouling material, and separates the spent abrasive and removed fouling material from the waste air, before the waste air is exhausted to the atmosphere.

After the plugs are removed from a ferromagnetic plug-type header, it is a further object of this invention to disclose a device that electromagnetically attaches to the face of the ferromagnetic plug-type header that permits workers to secure and position the supply and capture grit-resistant nozzles. Workers can thereby operate the nozzles without holding them by hand.

It is still a further object of this invention to disclose a ferromagnetic plate with securing apparatus that can attach to at least two of the threaded plugs in a non-ferromagnetic plug-type header or two of the threaded bolt holes in a ferromagnetic or non-ferromagnetic plate-type header thereby providing a surface upon which the electromagnetic nozzle support may be attached.

The invention described herein will substantially increase the safety for workers performing the cleaning of the interior of the tubes in air-cooled heat exchangers without sacrificing efficiency, economy, and environmental protection.

BRIEF DESCRIPTION OF THE SEVERAL VIEWS OF THE DRAWINGS AND LIST OF REFERENCE NUMBERS

LIST OF REFERENCE NUMBERS

| Number | Description |
|---|---|
| 100 | Electromagnetic nozzle support in place for tube cleaning |
| 102 | Electromagnet |
| 104 | Ferromagnetic plug-type header face |
| 106 | Grit-resistant nozzle |
| 108 | Nozzle holder |
| 110 | Ring |
| 112 | Sleeve |
| 114 | Hose connection |
| 116 | Grit-resistant hose |
| 118 | Sprocket |
| 120 | Magnet power cord |
| 122 | Battery back-up power supply |
| 124 | Power cord |
| 126 | Rack and pinion |
| 128 | Ratchet handle |
| 130 | Hole for safety strap |
| 132 | One of a plurality of holes in a plug-type header |
| 134 | Magnetic drill guide |
| 200 | Saddle |
| 202 | Handle |
| 300 | Switch |
| 400 | Stationary spring support |
| 402 | Spring |
| 404 | Arm |
| 406 | Movable spring support |
| 408 | Pawl |
| 410 | Pawl pivot |
| 500 | Pinch bolt |
| 600 | Major components of an air-cooled heat exchanger |
| 602 | One of a number of finned tubes |
| 604 | Inlet header |
| 606 | Inlet technician |
| 608 | Fan |
| 610 | Portable air compressor |
| 612 | Air hose |
| 614 | Grit chamber |
| 616 | Dust collector |
| 618 | Open-top 55-gallon drum |
| 620 | Outlet technician |
| 622 | Outlet header |
| 624 | Fines pot |
| 626 | Flex-hose |
| 628 | Modified drum lid |
| 700 | Plug |
| 800 | Ferromagnetic plate-type header |
| 802 | Bolt |
| 804 | Plate |
| 900 | O-ring |
| 1000 | Ferromagnetic plate |
| 1002 | Left t-handle |
| 1004 | Right t-handle |
| 1006 | Left elastomeric plug |
| 1008 | Right elastomeric plug |
| 1010 | Left slot |
| 1012 | Right slot |
| 1100 | Non-ferromagnetic plug-type header |
| 1102 | Magnetically supported nozzle attached to a non-ferromagnetic plug-type header |
| 1104 | One of a number of non-ferromagnetic finned tubes |
| 1106 | One of a plurality of holes in a non-ferromagnetic plug-type header |

DETAILED DESCRIPTION OF THE INVENTION

1. Detailed Description of the Preferred Embodiment of the Electromagnetic Nozzle Support An electromagnetic nozzle support is disclosed in detail that alleviates the need for inlet technician 606 and outlet technician 620 to manually hold their grit-resistant nozzles 106 and nozzle holders 108 against the tube ends during cleaning.

Figure 1:
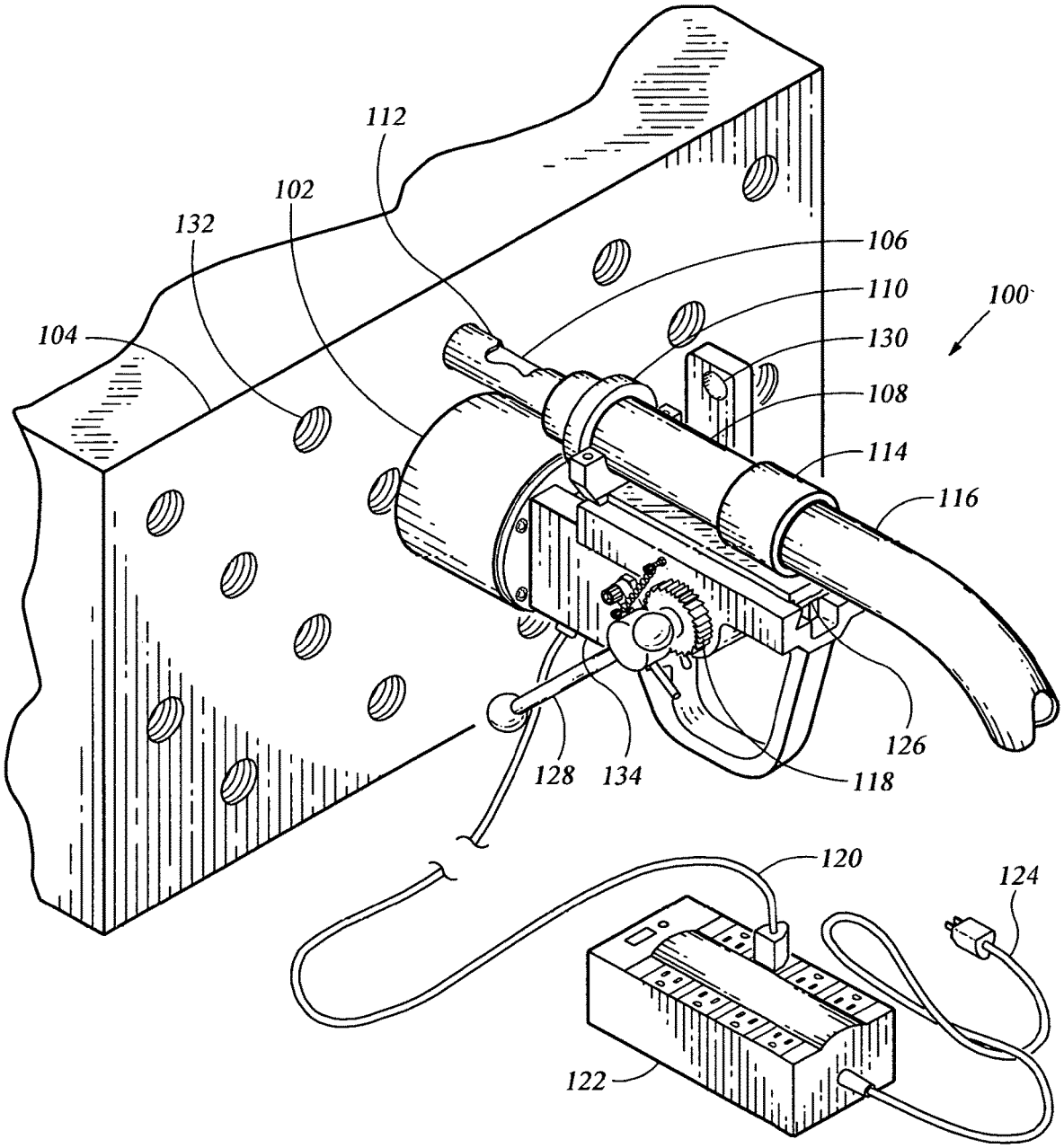
FIG. 1 depicts the electromagnetic nozzle support in place for the cleaning of tubes in a ferromagnetic plug-type header.

100 in FIG. 1 points to the electromagnetic nozzle support in place for cleaning one of several ferromagnetic tubes. The electromagnetic nozzle support comprises a portable electromagnetic drill guide 134, here a Kanetec® Magbore Model KCD-MN1-MWK1, manufactured and sold by Kanetec USA Corporation, but the invention may be practiced with another manufacturer's portable electromagnetic drill guide. FIG. 1 shows the features of Item 134 required to practice the invention. Item 102 is an electromagnet energized by single-phase 120 VAC power. It has a nominal holding force of 700 to 800 lbs. Item 126 is a rack and pinion to move the drill guide longitudinally forward and backward. Item 128 is a handle to move the rack and pinion. Item 130 is a hole for the connection of a safety strap to prevent the electromagnetic nozzle support from falling from position in a power failure. Electrical power for 134 is supplied through magnet power cord 120 connected to back-up power supply 122. Item 122 is provided to supply power to Item 134 in the event of a power failure. A back-up power supply 122 suitable to practice the invention is a nominal single-phase 120 VAC uninterruptable power supply with nominal 650 volt-amp (VA) capacity. Item 122 is supplied electrical power by power cord 124.

Figure 2:
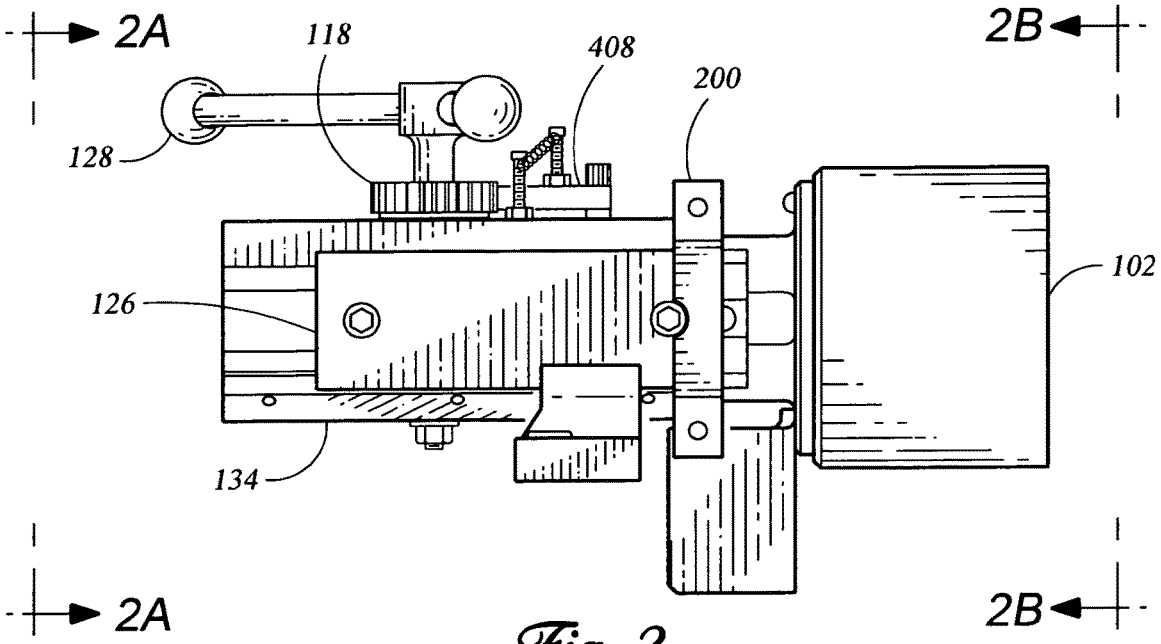
FIG. 2 shows the top view of the electromagnetic nozzle support.

As depicted more clearly in FIG. 2, Item 134 is modified by attaching a sprocket 118 and pawl 408 and other items to prevent the rack and pinion 126 from moving backwards once it is in a desired position. Arm 404 is used to release pawl 408 from sprocket 118 to permit rack and pinion 126 to be moved when it is appropriate.

FIG. 1 also shows the face of a ferromagnetic plug-type header 104 with plugs removed exposing one of several holes, 132, providing access to the tubes. A grit-resistant nozzle, 106, is shown secured in nozzle holder 108. A grit-resistant nozzle 106 suitable to practice the invention is an abrasive blast nozzle with high velocity profile and orifice diameter ranging from 3/16 inch to ½ inch depending on the inside diameter of the tube to be cleaned. Item 108 is connected to grit-resistant hose 116 using threaded connection 114. Ring 110 holds nozzle holder 108 in place during grit blasting. Item 106 is centered in a hole 132 by sleeve 112.

Figure 2A:
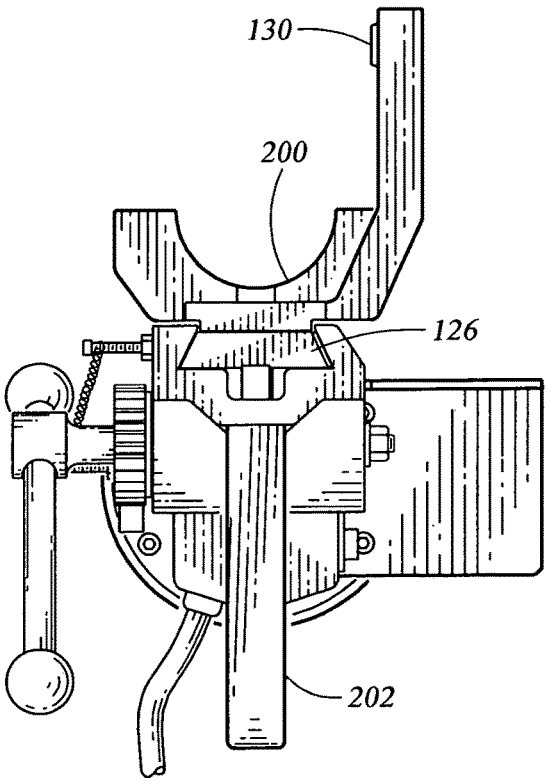
FIG. 2A shows a view of the top view of the electromagnetic nozzle support looking towards the end containing a rack and pinion.
Figure 2B:
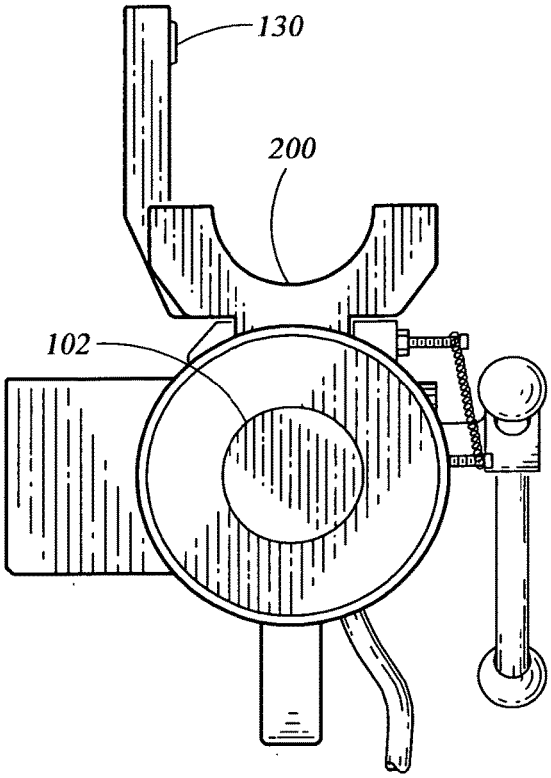
FIG. 2B depicts a view of the top view of the electromagnetic nozzle support looking towards the front of the electromagnet.

Returning to FIG. 2, Item 200 is a saddle in which nozzle holder 108 sits and ring 110 abuts on the side facing 104. FIG. 2 depicts other views of Items 102, 118, 126, 128, 134, and 408. FIG. 2A depicts handle 202, not shown on FIG. 1. It also shows another view of Items 126, 130 and 202. FIG. 2B shows additional views of Items 102, 130, and 200.

Figure 3:
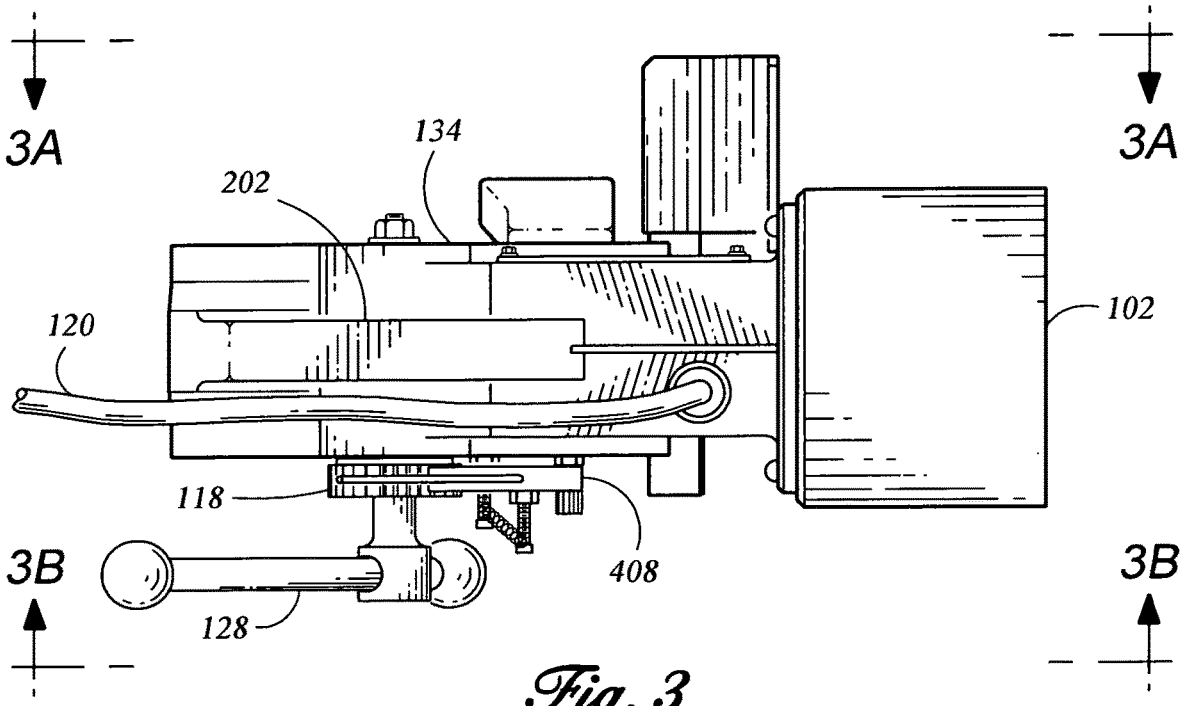
FIG. 3 shows the bottom view of the electromagnetic nozzle support.
Figure 3A:
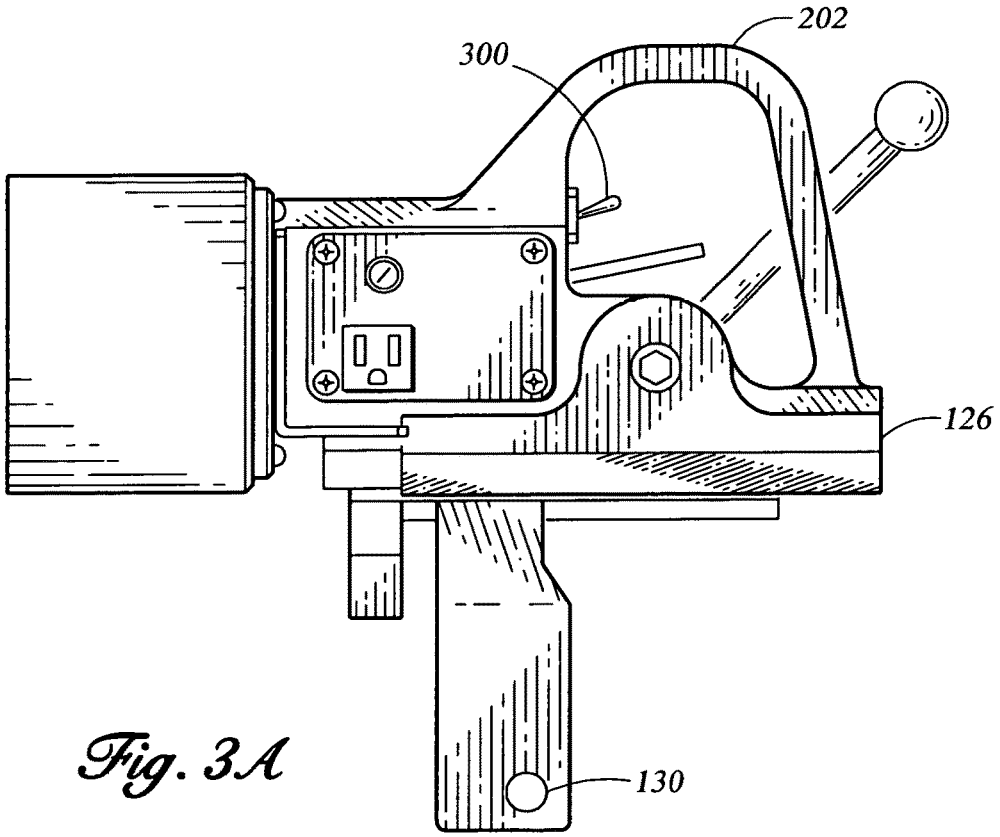
FIG. 3A is a left side view of the bottom view of the electromagnetic nozzle support.
Figure 3B:
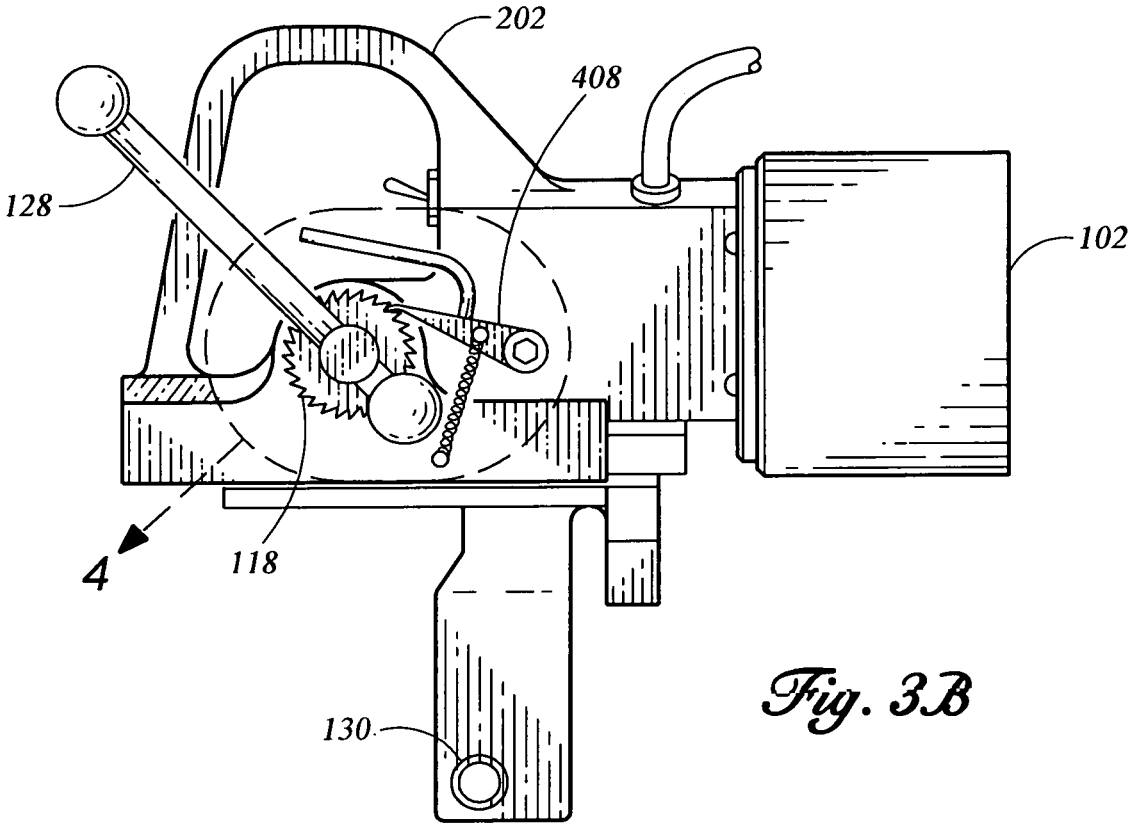
FIG. 3B is right side view of the bottom view of the electromagnetic nozzle support.

FIG. 3 is a bottom view of Item 134 as modified with 118 and 408. It depicts additional views of Items 102, 120, 128, and 202. FIG. 3A shows switch 300 and other views of Items 126, 130, and 202. FIG. 3B shows additional views of Items 102, 118, 128, 130, 202, and 408.

Figure 4:
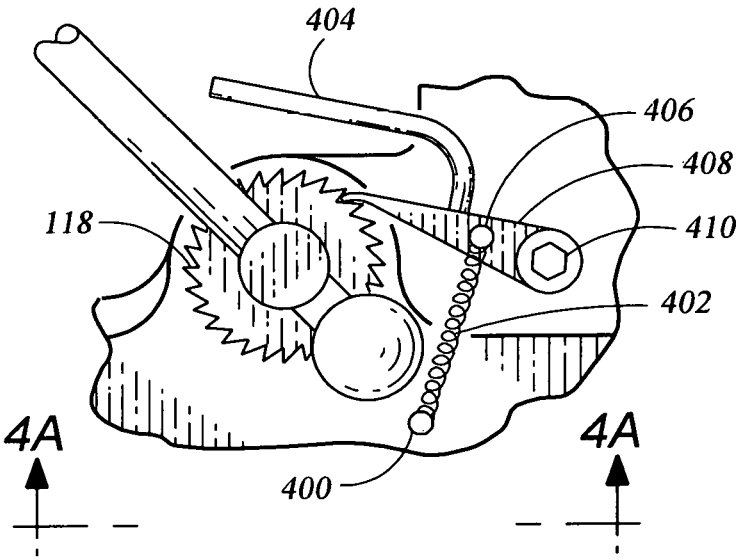
FIG. 4 depicts a top view of the sprocket and pawl used for positioning a grit-resistant nozzle.

FIG. 4 is a view looking down on sprocket 118 and pawl 408. Item 408 is kept in communication with Item 118 by spring 402. Spring 402 is supported by stationary spring support 400 and movable spring support 406 connected to pawl 408. Pawl 408 rotates on pawl pivot 410. Arm 404 is used to extend spring 402 to release pawl 408 from sprocket 118 allowing ratchet handle 128 to be rotated clockwise or counterclockwise thereby moving rack and pinion 126 forward or backward.

Figure 4A:
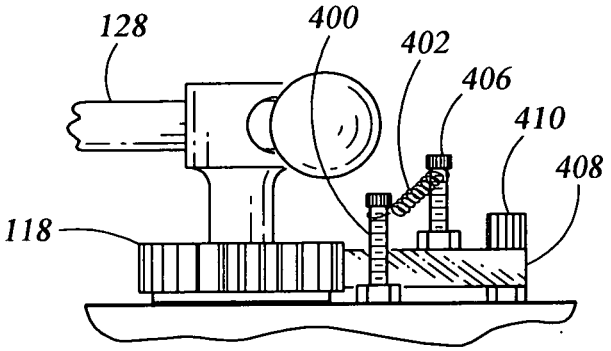
FIG. 4A shows a side view of the sprocket and pawl.

FIG. 4A is a view looking towards sprocket 118 with spring 402 to the right. It depicts additional views of Items 118, 128, 400, 402, 406, 408, and 410.

Figure 5:
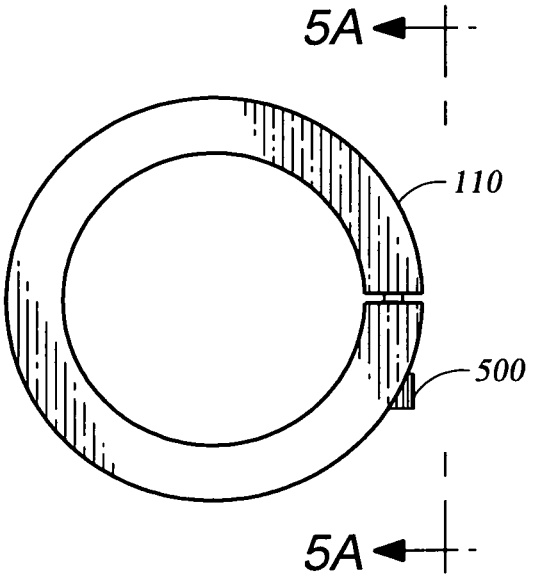
FIG. 5 shows a side view of the ring used to secure a grit-resistant nozzle to the electromagnetic nozzle support.
Figure 5A:
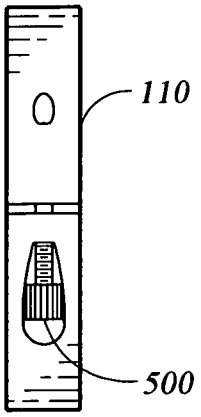
FIG. 5A depicts a top view of the ring.

FIG. 5 shows ring 110 which is used to communicate nozzle holder 108 with saddle 200. Pinch bolt 500 squeezes ring 110 to secure it to 108.

2. Detailed Description of the Preferred Embodiment of the System Incorporating the Electromagnetic Nozzle Support

Figure 6:
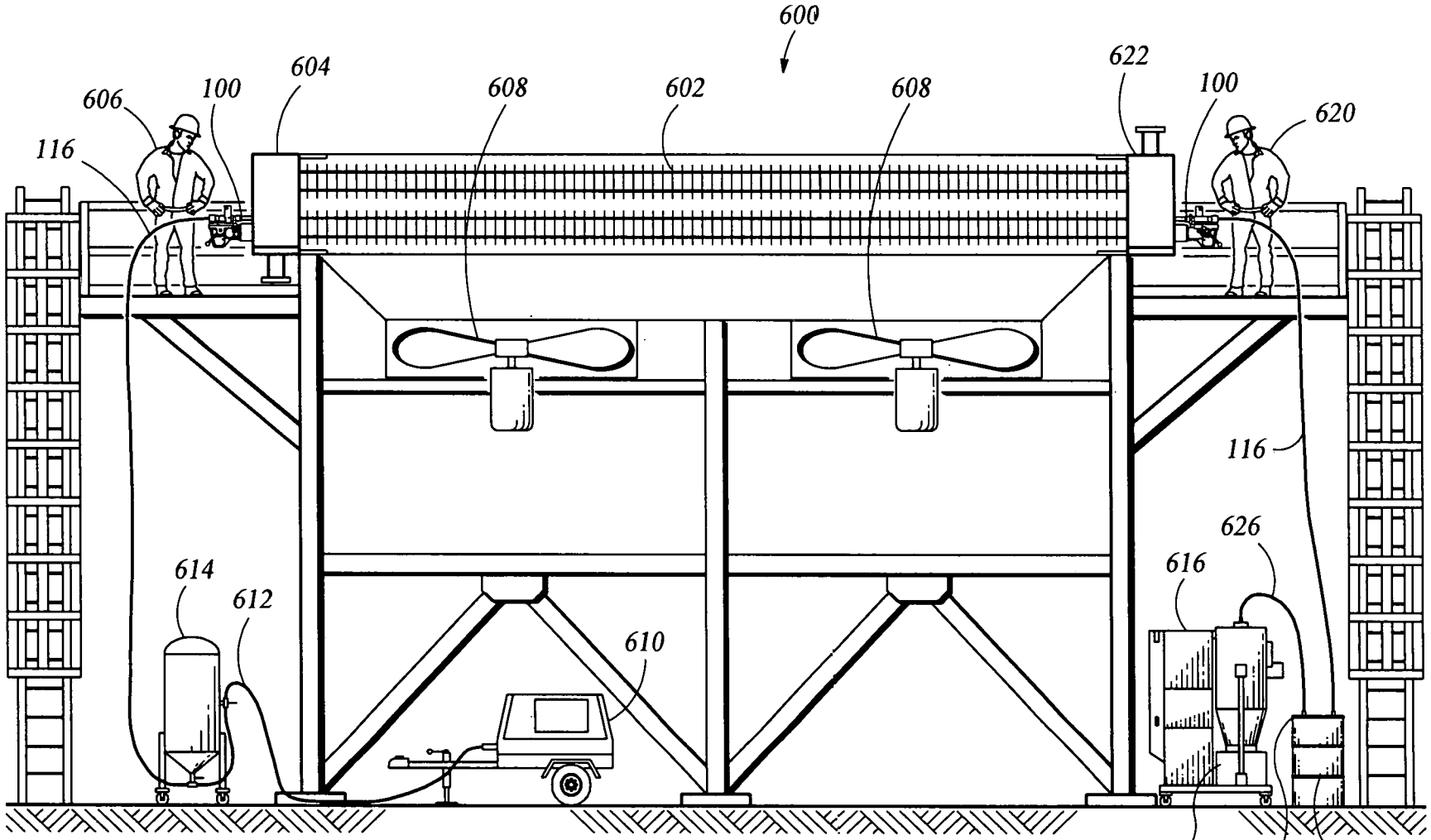
FIG. 6 shows a system for cleaning the interior of the tubes in an air-cooled heat exchanger using high pressure air with entrained abrasive and electromagnetic nozzle supports for securing the grit-resistant nozzles.

600 in FIG. 6 points to the relevant structural components of an air-cooled heat exchanger. Referring to FIG. 6, 602 is one of a plurality of finned tubes connected at inlet ends to an inlet header 604 and at outlet ends to an outlet header 622. Unless otherwise stated in this disclosure, it is understood that tubes 602, inlet header 604, and outlet header 622 may be constructed of ferromagnetic or non-ferromagnetic material and the headers may be plug-type or plate-type. Forced air is directed perpendicular to tube 602 by fans 608 to remove thermal energy from the fluid coursing through the tubes.

Figure 7:
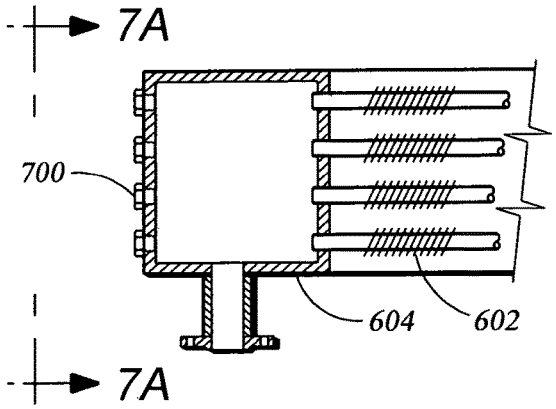
FIG. 7 shows the cross-section view of an air-cooled heat exchanger tube bundle with plug-type header and plugs in place.
Figure 7A:
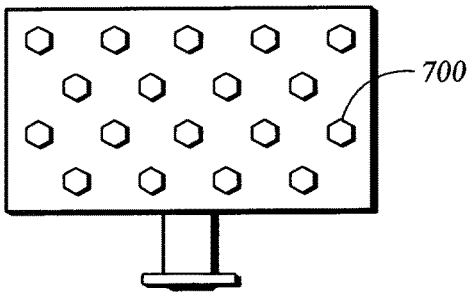
FIG. 7A shows an end view of an air-cooled heat exchanger tube bundle with plug-type header and plugs in place.

When tubes 602 are to be cleaned and Items 604 and 622 are plug-type headers of ferromagnetic material, they are prepared by removing plugs 700 shown in FIGS. 7 and 7A allowing access to the ends of the tubes. Item 132 in FIG. 1 shows a typical access point in a plug-type header 104.

FIG. 6 shows the additional equipment pieces and their communications required to prepare an air-cooled heat exchanger for tube cleaning. Portable air compressor 610 is connected to grit chamber 614 with air hose 612. Air hose 612 is industrial quality air hose with an inside diameter of at least 1 inch and no less than 250 PSIG maximum allowable working pressure and fittings appropriate for use and safety with high pressure air. A portable air compressor 610 suitable to practice the invention may any one of many portable air compressors rated for 375 ACFM at 150 PSIG. A suitable grit chamber 614 is one with a 6 Cu. Ft. to 6.5 Cu. Ft. pop-up abrasive blasting pot with at least a 150 PSIG maximum allowable working pressure and outfitted with a manually adjustable abrasive metering valve capable of remote opening or closing. Grit-resistant hose 116 connects at one end to the outlet of 614 and the other end to nozzle holder 108 using hose connection 114 positioned near 604. Grit-resistant hose 116 suitable to practice the invention is blast hose nominally 1¼ inch inside diameter by 1⅞ inch outside diameter, 1¼ inch inside diameter by 2 3/32 inch outside diameter, 1¼ inch inside diameter by 2 3/32 inch outside diameter, or 1½ inch inside diameter by 2⅜ inch outside diameter, all with at least 175 PSIG allowable working pressure, and hose connections appropriate for use and safety. At the other end of tube 602 at 622, a second 108 is connected to dust collector 616 by another grit-resistant hose 116 via a second 114. This Item 116 is connected to a first nozzle on modified lid 628 which sits atop open-top 55-gallon drum 618. Drum 618 provides a gross separation of the spent grit and debris removed from the tube interior from the waste air. Flex-hose 626 connects a second nozzle on 628 to dust collector 616. Item 626 suitable to practice the invention is 6-inch diameter flexible hose, with wire reinforcement, and able to withstand a slight vacuum or positive pressure. Dust collector 616 removes any fine grit or debris from the waste air not captured in drum 618. Fine grit or debris captured by dust collector 616 are collected in fines pot 624. Dust collector 616 suitable to practice the invention is a cartridge dust collector with integral forced-draft fan and nominal 1,000 CFM capacity at atmospheric pressure outfitted with cartridge filter media having a MERV of at least 14.

Additional items not shown in FIG. 6 are known to persons of skill in the art of grit blasting the tubes of an air-cooled heat exchanger. Inlet technician 606 is understood to have in hand a pneumatic or low voltage dead-man control valve or switch, respectively. Persons of skill in the art of grit blasting would recognize that one type of pneumatic dead-man control valve is a pneumatic remote control handle and an electrical control switch is a nominal 12-Volt DC electric remote control handle. The dead-man control valve or switch communicates with a pneumatically or electrically actuated shuttle valve. The shuttle valve admits pressurized air to open two air-to-open valves. The first air-to-open valve admits high pressure air from 610 via 612 to pressurize grit chamber 614 and a second air-to-open valve at the bottom of grit chamber 614 admits grit into the air stream. The second air-to-open valve is typically manually adjustable to control the abrasive loading. High pressure air with entrained grit is admitted to grit-resistant nozzle 106 only when inlet technician 606 depresses the dead-man control valve or switch. Air flow stops when inlet technician 606 releases the dead-man control valve or switch.

FIGS. 7 and 7A depict the cross-section and face of a plug-type header, respectively. Referring to FIG. 7, tubes 602 are connected to header 604. Plugs 700 are positioned in the face of the header directly opposite a corresponding tube 602 thus allowing access to the interior of that tube. It is known to persons with skill in the art that the inside diameter of a hole 132 created by the removal of a plug 700 is slightly larger than the inside diameter of tube 602. FIG. 7A shows plugs 700 arranged according to the arrangement of each corresponding tube.

Figure 8:
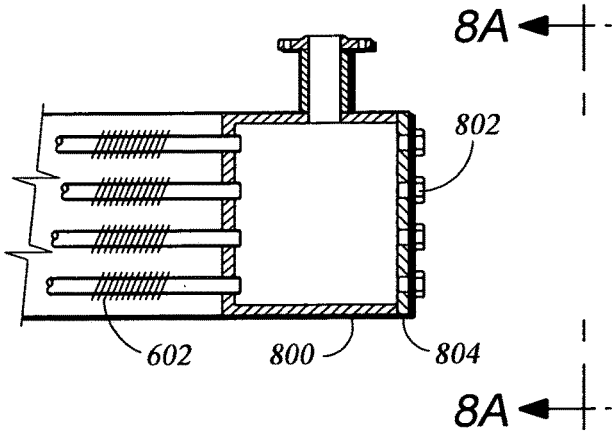
FIG. 8 shows the cross-section view of an air-cooled heat exchanger tube bundle with plate bolted to the periphery of a plate-type header.
Figure 8A:
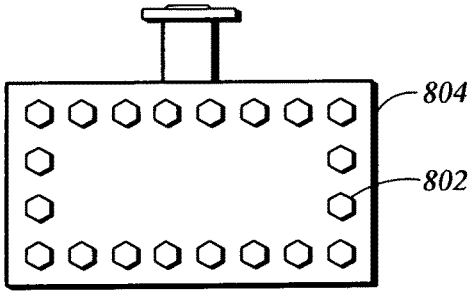
FIG. 8A shows an end view of an air-cooled heat exchanger tube bundle with plate bolted to the periphery of a plate-type header.

FIGS. 8 and 8A show the cross-section and face of a plate-type header, respectively. The periphery of plate 804 is bolted to plate-type header 800 with a plurality of bolts 802. FIG. 8A shows plate 804 with bolts 802 in place at the periphery.

Figure 9:
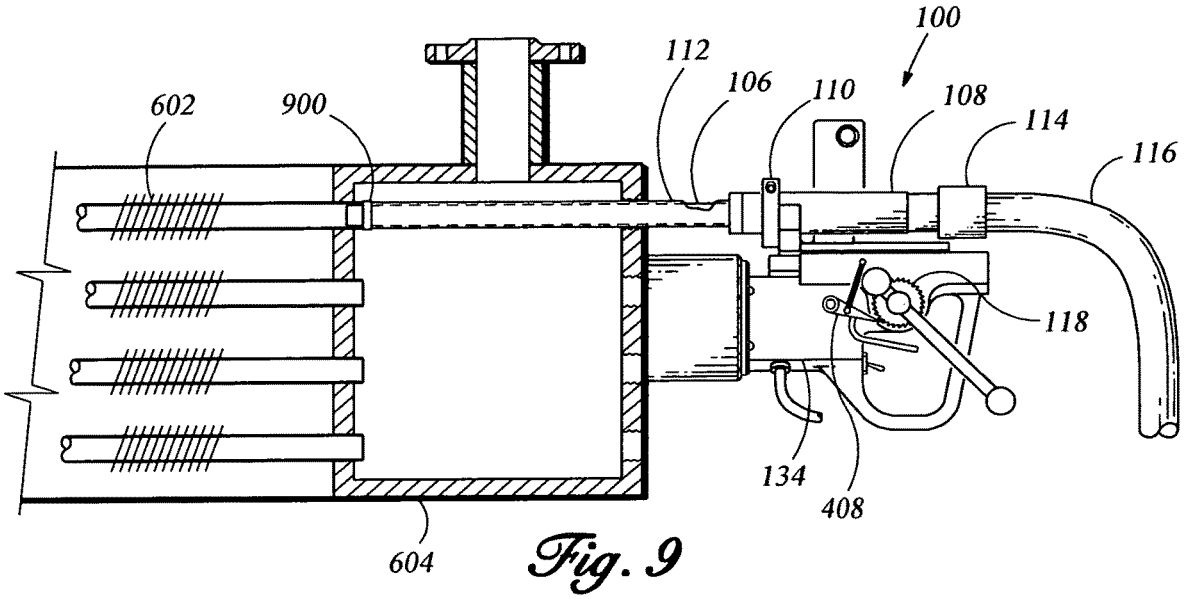
FIG. 9 shows a cut-away view of the electromagnetic nozzle support and grit-resistant nozzle with the nozzle in position for tube cleaning.

100 in FIG. 9 points to a cross-section view of Item 134 outfitted as an electromagnetic nozzle support electromagnetically connected to a ferromagnetic plug-type header 604. It is understood that the same is appropriate at 622. FIG. 9 also depicts previously described Items 106, 108, 110, 112, 114, and 116. Grit-resistant nozzle 106 extends through the interior of header 604 to the face of tube 602. O-ring 900 is positioned slightly inside the end of 106. This serves to both center and seal 106 against the end of tube 602.

Figure 10:
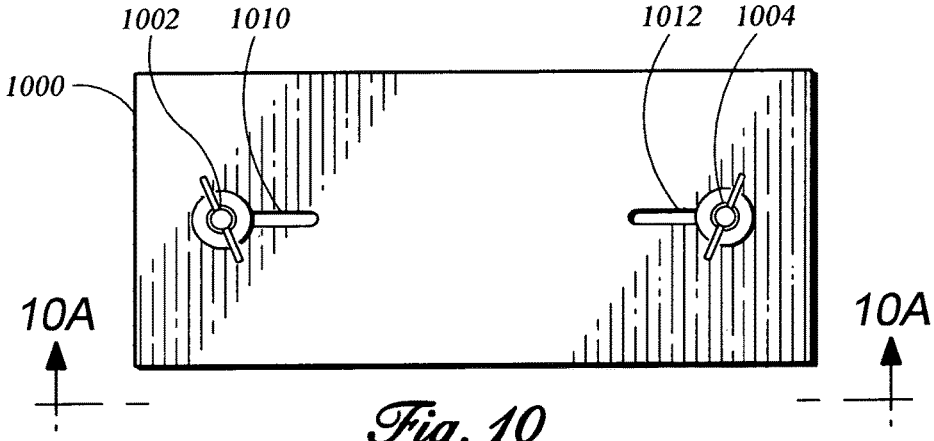
FIG. 10 shows a plan view of a ferromagnetic plate outfitted with expandable plugs to permit cleaning tubes connected to a non-ferromagnetic plug-type header or ferromagnetic or non-ferromagnetic plate-type header.
Figure 10A:
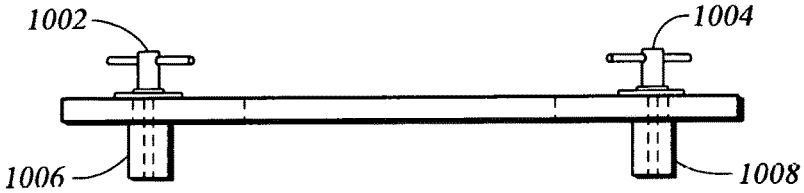
FIG. 10A shows a side view of the ferromagnetic plate with plugs expanded.

FIG. 10 shows ferromagnetic plate 1000 required to attach a 134 to a non-ferromagnetic plug-type header or a ferromagnetic or non-ferromagnetic plate-type header. Item 1000 is a rectangle with long side about one-half to two-third the length of the longest side of the non-ferromagnetic plug-type header or ferromagnetic or non-ferromagnetic plate-type header and the short side has a length of about one-half to two-third the length of the shortest side of the non-ferromagnetic plug-type header or ferromagnetic or non-ferromagnetic plate-type header upon which it is to be attached. Item 1000 has a thickness of one-fourth to three-eighth inch. Looking from above, Item 1000 has left slot 1010 and right slot 1012 which each accommodate left t-handle 1002 and right t-handle 1004, respectively. The slots are about one-half inch wide and three inches long with length-wise center-line parallel to the longest edge, centered between the two longest edges and positioned with the closest edge of each about six inches from its closest side. The slots permit 1000 to be attached to headers with different plug or bolt arrangements. FIG. 10A shows an edge-wise view of ferromagnetic plate 1000. It shows left elastomeric plug 1006 and right elastomeric plug 1008. As left t-handle 1002 or right t-handle 1004 is rotated clockwise looking downward on the t-handles, the elastomers forming 1006 or 1008 are compressed thereby increasing their diameters. Alternatively, when left t-handle 1002 or right t-handle 1004 is rotated counterclockwise, the elastomers forming 1006 or 1008 are decompressed thereby decreasing their diameters.

Figure 11:
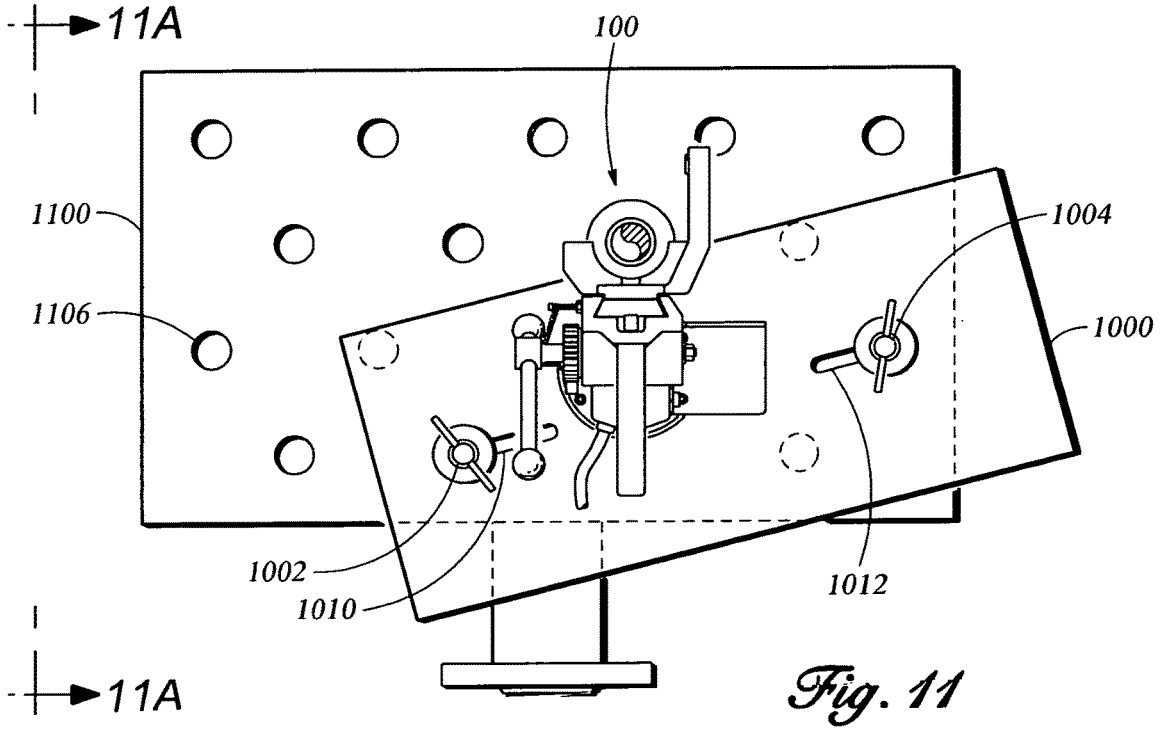
FIG. 11 depicts the electromagnetic nozzle support with affixed grit-resistant nozzle magnetically attached to the ferromagnetic plate for cleaning non-ferromagnetic tubes.

FIG. 11 shows 100 pointing to the electromagnetic nozzle support electromagnetically attached to 1000. Ferromagnetic plate 1000 is attached to a non-ferromagnetic plug-type header 1100. Left t-handle 1002 and right t-handle 1004 have been sufficiently rotated clockwise to expand respective 1006 and 1008 to communicate snugly with at least two holes depicted as 1106. Slots 1010 and 1012 permit 1000 to be favorably positioned against 1100.

Figure 11A:
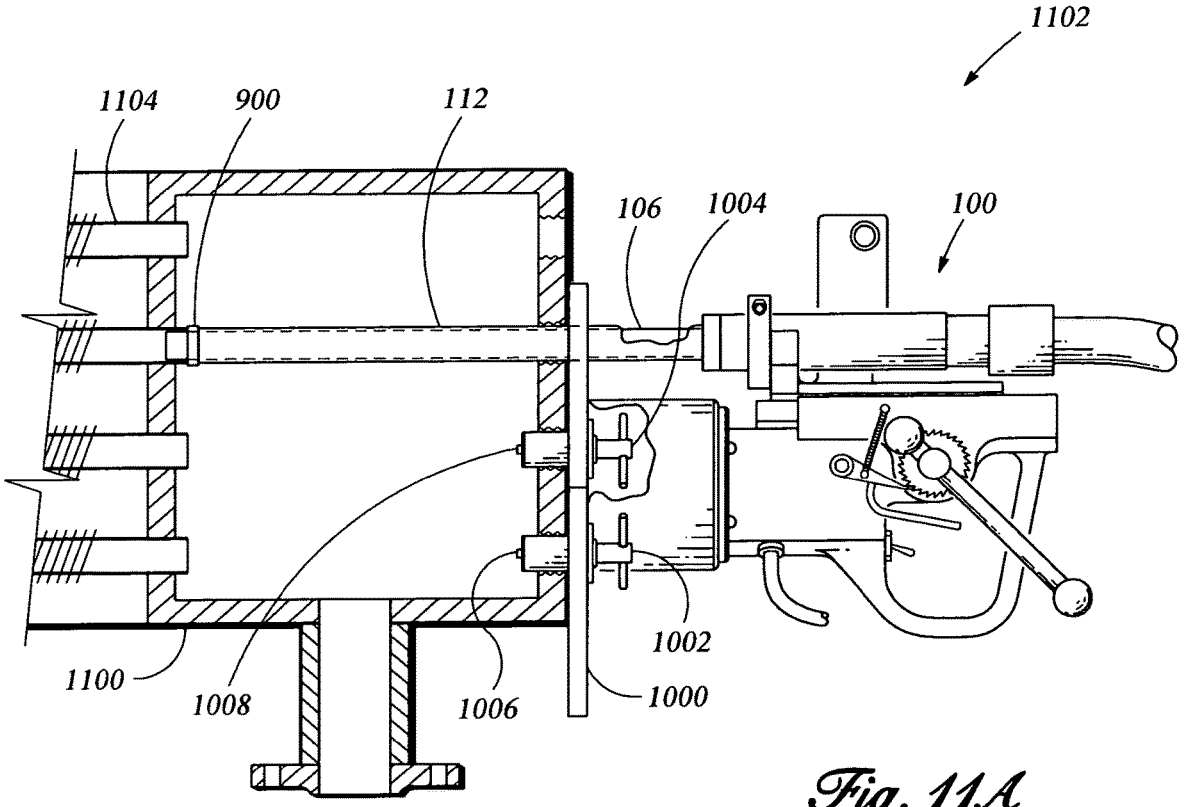
FIG. 11A shows a cut-away view of the electromagnetic nozzle support which is magnetically attached to a ferromagnetic plate with affixed grit-resistant nozzle for cleaning non-ferromagnetic tubes.

100 in FIG. 11A points to a cross-section of the electromagnetic nozzle support electromagnetically attached to a non-ferromagnetic plug-type header using 1000 connected to the header with 1002 and 1004 to compress 1006 and 1008, respectively. Slots 1010 and 1012 in 1000 permit it to be positioned for snug communication with header 1100. 1102 points to the entirety of 100 attached to 1000. Item 134 is positioned so that sleeve 112 and o-ring 900 both center and seal 106 against one of a non-ferromagnetic tube 1104.

It is understood that ferromagnetic plate 1000 will attach to a ferromagnetic or non-ferromagnetic plate-type header in the same fashion as depicted in FIGS. 11 and 11A, except that left plug 1006 and right plug 1008 are attached to two nonadjacent holes in the periphery of 800 created by the removal of all bolts 802 allowing the removal of plate 804. Once ferromagnetic plate 1000 is attached to 800, electromagnetic nozzle support 100 is attached to 1000 as previously described.

3. Detailed Description of the Preferred Embodiment of the Method of Using the Electromagnetic Nozzle Support to Clean Tubes Supported by a Ferromagnetic Plug-Type Header It is understood that the air-cooled heat exchanger represented by 600 in FIG. 6 has been made safe for cleaning. It is further understood that ferromagnetic tubes 602 are to be cleaned, each end of the tubes is connected to plug-type headers 604 and 622, and plugs 700 have been removed. The removal of plugs 700 exposes holes as shown as 132 in FIG. 1 to provide access to the tubes.

Referring to FIG. 6, equipment pieces, 610, 614, and 616 and drum 618 are staged at ground level adjacent to the air-cooled heat exchanger. An empty fines pot 624 is placed under 616. Air hose 612 is connected from 610 to 614. Item 614 is filled with grit suitable for the cleaning to be performed. Item 614 is prepared for pressurization. A first grit-resistant hose 116 is connected to 614. A second 116 is connected to a first nozzle on lid 628. Lid 628 is secured to drum 618 with several rounds of industrial adhesive tape. The free end of one 116 otherwise connected to 614 is carried to near inlet header 604. The free end of this 116 is secured to a structural member adjacent to inlet header 604. The free end of a second 116 connected to 628 is carried to near outlet header 622. The free end of this 116 is secured to a structural member adjacent to outlet header 622. Flex-hose 626 connects a second nozzle on lid 628 to an inlet nozzle on dust collector 616.

Referring to FIG. 9, a grit-resistant nozzle 106 of length pre-selected to reach from nozzle holder 108 to just inside tube 602 and of diameter pre-selected based on the inside diameter of tube 602 is hand-pressed into nozzle holder 108. Sleeve 112 of outside diameter pre-selected based on the inside diameter of hole 132 for a snug fit and inside diameter preselected based on the outside diameter of nozzle 106 for a snug fit is slid over 106 to a position where it will fit inside hole 132 when cleaning is to be performed. The length of sleeve 112 is measured to leave enough room for o-ring 900 to fit snugly around 106 while permitting 106 to protrude slightly beyond the face of 900. 0-ring 900 of outside diameter is pre-selected to be slightly larger than the inside diameter of tube 602 to permit 106 to slide inside tube 602 while sealing the outside perimeter of 602.

Continuing to refer to FIG. 9, nozzle holder 108, with 106, 112, and 900 in their proper pre-selected places, is taken in hand by inlet technician 606. Pinch bolt 500 in ring 110 is loosened enough so that ring 110 may be slid over nozzle holder 108. Ring 110 is left loose.

A battery back-up power supply 122 is located adjacent to each of headers 604 and 622. Power cord 124 is connected to a nominal 120 VAC single-phase power source to energize each of 122. Switch 300 shown in FIG. 3A is selected to the Off position on each of the 134 located adjacent to 604 and 622. A magnet power cord 120 from each of 134 is connected to each of 122.

Inlet technician 606 pushes nozzle holder with 106, 112, and 900 in their proper pre-selected places through a hole 132 until it communicates with the end of the tube 602 corresponding with 132. Outlet technician 620 performs the same task as inlet technician 606 but at outlet header 622. Sleeve 112 holds nozzle 106 and nozzle holder 108 in place. Ring 110 previously left loose is permitted to slide along 108. Inlet technician 606 positions 134 against the face of header 604 while simultaneously elevating it so that the edge of saddle 200 facing header 604 communicates with the edge of ring 110 facing away from 604. The same is performed by outlet technician 620 at 622.

Once Item 134 is properly positioned on the face of 604 and face of 622, inlet technician 606 and outlet technician 620 each select 300 on their respective 134 to the On position. Electromagnet 102 is energized magnetically coupling each 134 to the face of 604 and 622. By rotating handle 128, inlet technician 606 causes rack and pinion to move ring 110 towards saddle 200 until it communicates tightly against 200. Pawl 408 communicates with 118 via spring 402 to hold ring 110 snug against saddle 200. Inlet technician 606 then tightens pinch bolt 500 to cause ring 110 to communicate tightly around nozzle holder 108. The same is performed by outlet technician 620 at 622.

Inlet technician 606 connects grit-resistant hose 116 to nozzle holder 108 using hose connection 114. The same is performed by outlet technician 620 at 622. Inlet technician 606 and outlet technician 620 at each end of tube 602 communicate via walkie-talkie to confirm each are ready to begin tube cleaning. After confirmation, portable air compressor 610 is energized. Inlet technician depresses a dead-man control valve or dead-man switch known to persons of skill in the art. Once depressed, high pressure air flows through 612 to 614, picking up grit, then through 116, through 106, through tube 602, exits through the 106 at 622, then flows through 116 to 618, then through 618 to 616. Spent grit and debris removed from the interior of tube 602 is grossly collected in drum 618. Fines entrained in the waste air and passing through 618 are captured in 616 and collected in 624. The time required to clean a tube 602 may range from 10 seconds to 10 minutes.

After the pre-selected time for cleaning tube 602 is met, inlet technician 606 releases the dead-man valve or switch; thereby shutting off high pressure air and grit flowing from 614. Inlet technician 606 and outlet technician 620 communicate again by walkie-talkie. Inlet technician depresses arm 404 pulling pawl 408 away from sprocket 118. Handle 128 is rotated to cause rack and pinion to retract away from 604. The same is performed by outlet technician 620 at 622. The Item 134 at each of 604 and 622 is taken by hand and then de-energized by selecting 300 to the Off position. The Item 134 is allowed to safely fall away from the face of 604 and 622. Inlet technician 606 pulls nozzle holder with 106, 112, and 900 from hole 132 and reinserts it in the next 132 until it communicates with the end of the tube 602 corresponding with another 132. The same is performed by outlet technician 620 at 622. Inlet technician 606 again takes 134 by hand, repositions it against nozzle holder 108 and then re-energized by selecting 300 to the On position. The same is performed by outlet technician 620 at 622. Inlet technician 606 and outlet technician 620 communicate by walkie-talkie to confirm each is ready for tube cleaning. After confirmation, inlet technician 606 depresses dead-man control valve or switch to initiate tube cleaning. The process is repeated until all tubes 602 are cleaned.

4. Detailed Description of the Preferred Embodiment of the Method of Using the Electromagnetic Nozzle Support to Clean Tubes Supported by a Non-Ferromagnetic Plug-Type Header or a Ferromagnetic or Non-Ferromagnetic Plate-Type Header When inlet technician 606 and outlet technician 622 are confronted with a non-ferromagnetic plug-type header or a ferromagnetic or non-ferromagnetic plate-type header he or she must first attach ferromagnetic plate 1000 shown in FIGS. 10 and 10A to the header.

Inlet technician 606 and outlet technician 620 each prepare their ferromagnetic or non-ferromagnetic plate-type headers as shown in FIG. 8 by removing bolts 802 permitting plate 804 to be removed from header 800. For a non-ferromagnetic plug-type header, plugs like those of 700 in FIGS. 7 and 7A are removed.

Referring to FIG. 10, inlet technician 606 at 604 rotates left t-handle 1002 and right t-handle 1004 counterclockwise to decompress left plug 1006 and right plug 1008. Items 1006 and 1008 are decompressed sufficiently to cause their outside diameters to be slightly less than the inside diameters of hole 132 in a plug-type header or less than the inside diameter of a bolt hole in a plate-type header 800. The same is performed by outlet technician 620 at 622.

Referring to FIG. 11, inlet technician 606 places 1000 against the face of header 1100. He or she then positions left t-handle 1002 and right t-handle 1004 by sliding each in their respective left slot 1010 and right slot 1012, to cause left plug 1006 and right plug 1008 to each communicate with a hole 1106. Inlet technician 606 then rotates left t-handle 1002 and right t-handle 1004 clockwise to expand respective left plug 1006 and right plug 1008 to communicate snugly with the inside of two holes 1106. Once inlet technician 606 secures ferromagnetic plate 1000 to header 1100, Item 134 is electromagnetically attached to 1000 as if Item 134 was attached to header 604. Outlet technician 620 performs the same task at the 1100 at his or her end of 1104.

FIG. 11A shows a cross-sectional view of 100 electromagnetically attached to ferromagnetic plate 1000 which is in turn attached to non-ferromagnetic plug-header 1100. 1102 points to the entire assembly ready for cleaning non-ferromagnetic tube 1104. Cleaning tube 1104 proceeds as previously described.

It is understood that ferromagnetic plate 1000 will attach to a ferromagnetic or non-ferromagnetic plate-type header in the same fashion as depicted in FIGS. 11 and 11A, except that left plug 1006 and right plug 1008 are attached to two nonadjacent holes in the periphery of 800 created by the removal of all bolts 802 allowing the removal of plate 804. Once ferromagnetic plate 1000 is attached to 800, electromagnetic nozzle support 100 is attached to 1000 and cleaning tube 1104 proceeds as previously described.

5. Variations of the Preferred Embodiment can Still Remain Within the Scope of this Invention Persons of skill in the art of selecting, connecting, and modifying a portable electromagnetic drill guide would understand that the device, system, and method of using the device described in the preferred embodiment can vary and still remain within the invention herein described. Variations obvious to those persons skilled in the art are included in the invention.

This written description uses examples to disclose the invention, including the preferred embodiment, and also to enable a person of ordinary skill in the relevant art to practice the invention, including making and using any devices or systems and performing any incorporated methods. The patentable scope of the invention is defined by the claims, and may include other examples that occur to those person of ordinary skill in the art. Such other examples are intended to be within the scope of the claims if they have structural elements that do not differ from the literal language of the claims, or if they include equivalent structural elements with insubstantial differences from the literal language of the claims.

Further, multiple variations and modifications are possible in the embodiments of the invention described here. Although a certain illustrative embodiment of the invention has been shown and described here, a wide range of modifications, changes, and substitutions is contemplated in the foregoing disclosure. In some instances, some features of the present invention may be employed without a corresponding use of the other features. Accordingly, it is appropriate that the foregoing description be construed broadly and understood as being given by way of illustration and example only, the spirit and scope of the invention being limited only by the appended claims.

We claim:

1. A device for cleaning the interior of a heat exchange tube in an air-cooled heat exchanger, comprising:

(a) a magnetic drill guide with permanently affixed electromagnet and rack and pinion;
(b) a power supply with battery back-up;
(c) a frame attached to said rack and pinion to firmly but removably hold a grit-resistant nozzle;
(d) a sprocket and pawl attached to the rack and pinion;
(e) a grit-resistant nozzle;
(f) a connection point for a safety strap; whereby said device holds the grit-resistant nozzle firmly but removably inside the tube no more than the length of the grit-resistant nozzle.

2. A system for cleaning the interior of a heat exchange tube in an air-cooled heat exchanger, where said tube is fabricated of a ferromagnetic material, inlet of the tube is connected to an inlet ferromagnetic plug-type header, outlet of the tube is connected to an outlet ferromagnetic plug-type header, and the plugs are removed, comprising:

(a) a first device, comprising;
  (1) a magnetic drill guide with permanently affixed electromagnet and rack and pinion;
  (2) a first power supply with battery back-up;
  (3) a frame attached to said rack and pinion to firmly but removably hold a grit-resistant nozzle;
  (4) a sprocket and pawl attached to the rack and pinion;
  (5) a first grit-resistant nozzle;
  (6) a connection point for a safety strap;
(b) a second device, comprising;
  (1) a magnetic drill guide with permanently affixed electromagnet and rack and pinion;
  (2) a second power supply with battery back-up;
  (3) a frame attached to said rack and pinion to firmly but removably hold a grit-resistant nozzle;
  (4) a sprocket and pawl attached to the rack and pinion;
  (5) a second grit-resistant nozzle;
  (6) a connection point for a safety strap;
(c) a portable air compressor;
(d) a grit chamber;
(e) grit;
(f) a first hose;
(g) a second hose;
(h) a third hose;
(i) a portable drum;
(j) a lid for said portable drum;
(k) a fourth hose; and
(l) a portable dust collector; whereby the first device holds the first grit-resistant nozzle firmly but removably inside the inlet of the tube at the inlet ferromagnetic plug-type header no more than the length of the first grit-resistant nozzle and the second device holds the second grit-resistant nozzle firmly but removably inside the outlet of the tube at the outlet ferromagnetic plug-type header no more than the length of the second grit-resistant nozzle.

3. A system for cleaning the interior of a heat exchange tube in an air-cooled heat exchanger where said tube is fabricated of a non-ferromagnetic material, inlet of the tube is connected to an inlet non-ferromagnetic plug-type header, outlet of the tube is connected to an outlet non-ferromagnetic plug-type header, and the plugs are removed, comprising:

(a) a first device, comprising;
  (1) a magnetic drill guide with permanently affixed electromagnet and rack and pinion;
  (2) a first power supply with battery back-up;
  (3) a frame attached to said rack and pinion to firmly but removably hold a grit-resistant nozzle;
  (4) a sprocket and pawl attached to the rack and pinion;
  (5) a first grit-resistant nozzle;
  (6) a connection point for a safety strap;
(b) a second device, comprising;
  (1) a magnetic drill guide with permanently affixed electromagnet and rack and pinion;
  (2) a second power supply with battery back-up;
  (3) a frame attached to said rack and pinion to firmly but removably hold a grit-resistant nozzle;
  (4) a sprocket and pawl attached to the rack and pinion;
  (5) a second grit-resistant nozzle;
  (6) a connection point for a safety strap;
(c) a first ferromagnetic plate;
(d) a second ferromagnetic plate;
(e) a portable air compressor;
(f) a grit chamber;
(g) grit;
(h) a first hose;
(i) a second hose;
(j) a third hose;
(k) a portable drum;
(l) a lid for said portable drum;

(m) a fourth hose; and (n) a portable dust collector; whereby said first ferromagnetic plate is firmly but removably attached to said inlet non-ferromagnetic plug-type header, said first device, electromagnetically attached to the first ferromagnetic plate, holds said first grit-resistant nozzle firmly but removably inside the inlet of the tube at the inlet non-ferromagnetic plug-type header no more than the length of the first grit-resistant nozzle, said second ferromagnetic plate is firmly but removably attached to said outlet non-ferromagnetic plug-type header, said second device, electromagnetically attached to the second ferromagnetic plate, holds said second grit-resistant nozzle firmly but removably inside the outlet of the tube at the outlet non-ferromagnetic plug-type header no more than the length of the second grit-resistant nozzle.

4. A system for cleaning the interior of a heat exchange tube in an air-cooled heat exchanger where said tube is fabricated of a ferromagnetic material, inlet of the tube is connected to an inlet ferromagnetic plate-type header, outlet of the tube is connected to an outlet ferromagnetic plate-type header, all bolts securing the plates and plates are removed, comprising:

(a) a first device, comprising;
  (1) a magnetic drill guide with permanently affixed electromagnet and rack and pinion;
  (2) a first power supply with battery back-up;
  (3) a frame attached to said rack and pinion to firmly but removably hold a grit-resistant nozzle;
  (4) a sprocket and pawl attached to the rack and pinion;
  (5) a first grit-resistant nozzle;
  (6) a connection point for a safety strap;

(b) a second device, comprising;
  (1) a magnetic drill guide with permanently affixed electromagnet and rack and pinion;
  (2) a second power supply with battery back-up;
  (3) a frame attached to said rack and pinion to firmly but removably hold a grit-resistant nozzle;
  (4) a sprocket and pawl attached to the rack and pinion;
  (5) a second grit-resistant nozzle;
  (6) a connection point for a safety strap;

(c) a first ferromagnetic plate;

(d) a second ferromagnetic plate;

(e) a portable air compressor;

(f) a grit chamber;

(g) grit;

(h) a first hose;

(i) a second hose;

(j) a third hose;

(k) a portable drum;

(l) a lid for said portable drum;

(m) a fourth hose; and (n) a portable dust collector; whereby said first ferromagnetic plate is firmly but removably attached to said inlet ferromagnetic plate-type header, said first device, electromagnetically attached to the first ferromagnetic plate, holds said first grit-resistant nozzle firmly but removably inside the inlet of the tube at the inlet ferromagnetic plate-type header no more than the length of the first grit-resistant nozzle, said second ferromagnetic plate is firmly but removably attached to said outlet ferromagnetic plate-type header, said second device, electromagnetically attached to the second ferromagnetic plate, holds said second grit-resistant nozzle firmly but removably inside the outlet of the tube at the outlet ferromagnetic plate-type header no more than the length of the second grit-resistant nozzle.

5. A system for cleaning the interior of a heat exchange tube in an air-cooled heat exchanger where said tube is fabricated of a non-ferromagnetic material, inlet of the tube is connected to an inlet non-ferromagnetic plate-type header, outlet of the tube is connected to an outlet non-ferromagnetic plate-type header, all bolts securing the plates and plates are removed, comprising:

(a) a first device, comprising;
  (1) a magnetic drill guide with permanently affixed electromagnet and rack and pinion;
  (2) a first power supply with battery back-up;
  (3) a frame attached to said rack and pinion to firmly but removably hold a grit-resistant nozzle;
  (4) a sprocket and pawl attached to the rack and pinion;
  (5) a first grit-resistant nozzle;
  (6) a connection point for a safety strap;

(b) a second device, comprising;
  (1) a magnetic drill guide with permanently affixed electromagnet and rack and pinion;
  (2) a second power supply with battery back-up;
  (3) a frame attached to said rack and pinion to firmly but removably hold a grit-resistant nozzle;
  (4) a sprocket and pawl attached to the rack and pinion;
  (5) a second grit-resistant nozzle;
  (6) a connection point for a safety strap;

(c) a first ferromagnetic plate;

(d) a second ferromagnetic plate;

(e) a portable air compressor;

(f) a grit chamber;

(g) grit;

(h) a first hose;

(i) a second hose;

(j) a third hose;

(k) a portable drum;

(l) a lid for said portable drum;

(m) a fourth hose; and (n) a portable dust collector; whereby said first ferromagnetic plate is firmly but removably attached to said inlet non-ferromagnetic plate-type header, said first device, electromagnetically attached to the first ferromagnetic plate, holds said first grit-resistant nozzle firmly but removably inside the inlet of the tube at the inlet non-ferromagnetic plate-type header no more than the length of the first grit-resistant nozzle, said second ferromagnetic plate is firmly but removably attached to said outlet non-ferromagnetic plate-type header, said second device, electromagnetically attached to the second ferromagnetic plate, holds said second grit-resistant nozzle firmly but removably inside the outlet of the tube at the outlet non-ferromagnetic plate-type header no more than the length of the second grit-resistant nozzle.

6. The device in claim 1, wherein:

(a) the electromagnet is energized by single phase nominal 120 VAC producing a nominal attachment force of 750 to 800 pounds;

(b) the power supply with battery backup is a single phase nominal 120 VAC power supply with nominal 650 VA capacity;

(c) the frame is a nozzle holder with ring tightly clamped around said nozzle holder and the nozzle holder supported by a saddle;

(d) the grit-resistant nozzle is an abrasive blast nozzle with high velocity profile and orifice diameter ranging from 3/16 inch to ½ inch;

(e) the connection point for a safety strap is a hole nominally three-eighths inch in diameter.

7. The system in claim 2, wherein:

(a) the first device is firmly but removably attached to the face of the inlet ferromagnetic plug-type header by the electromagnet energized by single phase nominal 120 VAC and having nominal attachment force of 750 to 800 pounds;

(b) the second device is firmly but removably attached to the face of the outlet ferromagnetic plug-type header by the electromagnet energized by single phase nominal 120 VAC and having nominal attachment force of 750 to 800 pounds;

(c) the first power supply with battery back-up is energized by single phase nominal 120 VAC electrical power and has nominal capacity of 650 VA;

(d) the second power supply with battery back-up is energized by single phase nominal 120 VAC electrical power and has nominal capacity of 650 VA;

(e) the first device firmly but removably holds the first grit-resistant nozzle by a ring tightly clamped around a first nozzle holder and said first nozzle holder is supported by a saddle;

(f) the second device firmly but removably holds the second grit-resistant nozzle by a ring tightly clamped around a second nozzle holder and said second nozzle holder is supported by a saddle;

(g) the first grit-resistant nozzle is an abrasive blast nozzle with high velocity profile and orifice diameter ranging from 3/16 inch to ½ inch;

(h) the second grit-resistant nozzle is an abrasive blast nozzle with high velocity profile and orifice diameter ranging from 3/16 inch to ½ inch;

(i) the frame is a nozzle holder with ring tightly clamped around said nozzle holder and the nozzle holder supported by a saddle;

(j) the portable air compressor delivers high pressure air at a volumetric flow rate of 350 to 400 ACFM at a pressure of 100 to 150 PSIG;

(k) the grit chamber has a capacity of 6 to 6.5 Cu. Ft. and an operating pressure of at least 150 PSIG and is outfitted with an abrasive metering valve;

(l) the grit is garnet with a size range of 30 to 60 mesh and Mohs' hardness of 7.5 to 8;

(m) the first hose is industrial quality air hose with at least 250 PSIG maximum allowable working pressure and an inside diameter of at least 1 inch and of sufficient length to connect the portable air compressor and the grit chamber;

(n) the second hose is blast hose with at least 175 PSIG allowable working pressure, 1¼ inch inside diameter by 1⅞ inch outside diameter, or 2-braid blast hose 1¼ inch inside diameter by 2 3/32 inch outside diameter, or 4-ply blast hose 1¼ inch inside diameter by 2 3/32 inch outside diameter, or 4-ply blast hose 1½ inch inside diameter by 2⅜ inch outside diameter, and sufficient length to connect the grit chamber and the first grit-resistant nozzle;

(o) the third hose is blast hose with at least 175 PSIG allowable working pressure, 1¼ inch inside diameter by 1⅞ inch outside diameter, or 2-braid blast hose 1¼ inch inside diameter by 2 3/32 inch outside diameter, or 4-ply blast hose 1¼ inch inside diameter by 2 3/32 inch outside diameter, or 4-ply blast hose 1½ inch inside diameter by 2⅜ inch outside diameter, and sufficient length to connect the second grit-resistant nozzle to the portable drum;

(p) the abrasive metering valve admits grit to said high pressure air to achieve a grit to air ratio of 1 to 10 LBS per 100 ASCF at 125 PSIG;

(q) the portable drum is an open-top 55-gallon drum of carbon steel;

(r) the lid for said portable drum has a first nozzle of diameter and configuration to attach the third hose and a second nozzle of diameter and configuration to attach the fourth hose;

(s) the portable dust collector has nominal capacity of 1,000 CFM at atmospheric pressure, with integral forced-draft fan, and outfitted with filter media with a MERV of at least 14; and (t) the fourth hose is flexible hose of nominal 6 inches in diameter, capable of withstanding slightly supra-atmospheric pressure, and of sufficient length to connect the portable drum to the portable dust collector.

8. The system in claim 3, wherein:

(a) the first ferromagnetic plate;

(1) is fabricated of a ferromagnetic material;

(2) is a rectangle with long side one-half to two-third the length of the longest face of the inlet non-ferromagnetic plug-type header and with short side one-half to two-third the length of the shortest face of the inlet non-ferromagnetic plug-type header;

(3) has a thicknesses of one-fourth inch to three-eighth inch;

(4) has two slots about one-half inch wide and three inches long with length-wise center-line parallel to the longest edge and centered between the two longest edges and positioned with the closest edge of each about six inches from its closest side;

(5) the slots each contain a t-handle on one side communicating with a compressible plug on the other side allowing said compressible plug to be expanded or contracted by rotation of the t-handle clockwise or counter-clockwise;

(6) is firmly but removably attached to the face of the inlet non-ferromagnetic plug-type header by expanding a first compressible plug into a tube and a second compressible plug into another tube;

(b) the second ferromagnetic plate;

(1) is fabricated of a ferromagnetic material;

(2) is a rectangle with long side one-half to two-third the length of the longest face of the outlet non-ferromagnetic plug-type header and with short side one-half to two-third the length of the shortest face of the outlet non-ferromagnetic plug-type header;

(3) has a thicknesses of one-fourth inch to three-eighth inch;

(4) has two slots about one-half inch wide and three inches long with length-wise center-line parallel to the longest edge and centered between the two longest edges and positioned with the closest edge of each about six inches from its closest side;

(5) the slots each contain a t-handle on one side communicating with a compressible plug on the other side allowing said compressible plug to be expanded or contracted by rotation of the t-handle clockwise or counter-clockwise;

(6) is firmly but removably attached to the face of the outlet non-ferromagnetic plug-type header by expanding a first compressible plug into a tube and a second compressible plug into another tube;

(c) the first device is firmly but removably attached to the face of the first ferromagnetic plate by the electromagnet energized by single phase nominal 120 VAC and having nominal attachment force of 750 to 800 pounds;

(d) the second device is firmly but removably attached to the face of the second ferromagnetic plate by the electromagnet energized by single phase nominal 120 VAC and having nominal attachment force of 750 to 800 pounds;

(e) the first power supply with battery back-up is energized by single phase nominal 120 VAC electrical power and has nominal capacity of 650 VA;

(f) the second power supply with battery back-up is energized by single phase nominal 120 VAC electrical power and has nominal capacity of 650 VA;

(g) the first device firmly but removably holds the first grit-resistant nozzle by a ring tightly clamped around a first nozzle holder and said first nozzle holder is supported by a saddle;

(h) the second device firmly but removably holds the second grit-resistant nozzle by a ring tightly clamped around a second nozzle holder and said second nozzle holder is supported by a saddle;

(i) the first grit-resistant nozzle is an abrasive blast nozzle with high velocity profile and orifice diameter ranging from 3/16 inch to ½ inch;

(j) the second grit-resistant nozzle is an abrasive blast nozzle with high velocity profile and orifice diameter ranging from 3/16 inch to ½ inch.

(k) the frame is a nozzle holder with ring tightly clamped around said nozzle holder and the nozzle holder supported by a saddle.

(l) the portable air compressor delivers high pressure air at a volumetric flow rate of 350 to 400 ACFM at a pressure of 100 to 150 PSIG;

(m) the grit chamber has a capacity of 6 to 6.5 Cu. Ft. and an operating pressure of at least 150 PSIG and is outfitted with an abrasive metering valve;

(n) the grit is garnet with a size range of 30 to 60 mesh and Mohs' hardness of 7.5 to 8;

(o) the first hose is industrial quality air hose with at least 250 PSIG maximum allowable working pressure and an inside diameter of at least 1 inch and of sufficient length to connect the portable air compressor and the grit chamber;

(p) the second hose is blast hose with at least 175 PSIG allowable working pressure, 1¼ inch inside diameter by 1⅞ inch outside diameter, or 2-braid blast hose 1¼ inch inside diameter by 2 3/32 inch outside diameter, or 4-ply blast hose 1¼ inch inside diameter by 2 3/32 inch outside diameter, or 4-ply blast hose 1½ inch inside diameter by 2⅜ inch outside diameter, and sufficient length to connect the grit chamber and the first grit-resistant nozzle;

(q) the third hose is blast hose with at least 175 PSIG allowable working pressure, 1¼ inch inside diameter by 1⅞ inch outside diameter, or 2-braid blast hose 1¼ inch inside diameter by 2 3/32 inch outside diameter, or 4-ply blast hose 1¼ inch inside diameter by 2 3/32 inch outside diameter, or 4-ply blast hose 1½ inch inside diameter by 2⅜ inch outside diameter, and sufficient length to connect the second grit-resistant nozzle to the portable drum;

(r) the abrasive metering valve admits grit to said high pressure air to achieve a grit to air ratio of 1 to 10 LBS per 100 ASCF at 125 PSIG;

(s) the portable drum is an open-top 55-gallon drum of carbon steel;

(t) the lid for said portable drum has a first nozzle of diameter and configuration to attach the third hose and a second nozzle of diameter and configuration to attach the fourth hose;

(u) the portable dust collector has nominal capacity of 1,000 CFM at atmospheric pressure, with integral forced-draft fan, and outfitted with filter media with a MERV of at least 14; and (v) the fourth hose is flexible hose of nominal 6 inches in diameter, capable of withstanding slightly supra-atmospheric pressure, and of sufficient length to connect the portable drum to the portable dust collector.

9. The system in claim 4, wherein:

(a) the first ferromagnetic plate;

(1) is fabricated of a ferromagnetic material;

(2) is a rectangle with long side one-half to two-third the length of the longest face of the inlet ferromagnetic plate-type header and with short side one-half to two-third the length of the shortest face of the inlet ferromagnetic plate-type header;

(3) has a thicknesses of one-fourth inch to three-eighth inch;

(4) has two slots about one-half inch wide and three inches long with length-wise center-line parallel to the longest edge and centered between the two longest edges and positioned with the closest edge of each about six inches from its closest side;

(5) the slots each contain a t-handle on one side communicating with a compressible plug on the other side allowing said compressible plug to be expanded or contracted by rotation of the t-handle clockwise or counter-clockwise;

(6) is firmly but removably attached to the face of the inlet ferromagnetic plate-type header by expanding a first compressible plug into a tube and a second compressible plug into another tube;

(b) the second ferromagnetic plate;

(1) is fabricated of a ferromagnetic material;

(2) is a rectangle with long side one-half to two-third the length of the longest face of the outlet ferromagnetic plate-type header and with short side one-half to two-third the length of the shortest face of the outlet ferromagnetic plate-type header;

(3) has a thicknesses of one-fourth inch to three-eighth inch;

(4) has two slots about one-half inch wide and three inches long with length-wise center-line parallel to the longest edge and centered between the two longest edges and positioned with the closest edge of each about six inches from its closest side;

(5) the slots each contain a t-handle on one side communicating with a compressible plug on the other side allowing said compressible plug to be expanded or contracted by rotation of the t-handle clockwise or counter-clockwise;

(6) is firmly but removably attached to the face of the outlet ferromagnetic plate-type header by expanding a first compressible plug into a tube and a second compressible plug into another tube;

(c) the first device is firmly but removably attached to the face of the first ferromagnetic plate by the electromagnet energized by single phase nominal 120 VAC and having nominal attachment force of 750 to 800 pounds;

(d) the second device is firmly but removably attached to the face of the second ferromagnetic plate by the electromagnet energized by single phase nominal 120 VAC and having nominal attachment force of 750 to 800 pounds;

(e) the first power supply with battery back-up is energized by single phase nominal 120 VAC electrical power and has nominal capacity of 650 VA;

(f) the second power supply with battery back-up is energized by single phase nominal 120 VAC electrical power and has nominal capacity of 650 VA;

(g) the first device firmly but removably holds the first grit-resistant nozzle by a ring tightly clamped around a first nozzle holder and said first nozzle holder is supported by a saddle;

(h) the second device firmly but removably holds the second grit-resistant nozzle by a ring tightly clamped around a second nozzle holder and said second nozzle holder is supported by a saddle;

(i) the first grit-resistant nozzle is an abrasive blast nozzle with high velocity profile and orifice diameter ranging from 3/16 inch to 1/2 inch;

(j) the second grit-resistant nozzle is an abrasive blast nozzle with high velocity profile and orifice diameter ranging from 3/16 inch to 1/2 inch.

(k) the frame is a nozzle holder with ring tightly clamped around said nozzle holder and the nozzle holder supported by a saddle.

(l) the portable air compressor delivers high pressure air at a volumetric flow rate of 350 to 400 ACFM at a pressure of 100 to 150 PSIG;

(m) the grit chamber has a capacity of 6 to 6.5 Cu. Ft. and an operating pressure of at least 150 PSIG and is outfitted with an abrasive metering valve;

(n) the grit is garnet with a size range of 30 to 60 mesh and Mohs' hardness of 7.5 to 8;

(o) the first hose is industrial quality air hose with at least 250 PSIG maximum allowable working pressure and an inside diameter of at least 1 inch and of sufficient length to connect the portable air compressor and the grit chamber;

(p) the second hose is blast hose with at least 175 PSIG allowable working pressure, 1 1/4 inch inside diameter by 1 7/8 inch outside diameter, or 2-braid blast hose 1 1/4 inch inside diameter by 2 3/32 inch outside diameter, or 4-ply blast hose 1 1/4 inch inside diameter by 2 3/32 inch outside diameter, or 4-ply blast hose 1 1/2 inch inside diameter by 2 3/8 inch outside diameter, and sufficient length to connect the grit chamber and the first grit-resistant nozzle;

(q) the third hose is blast hose with at least 175 PSIG allowable working pressure, 1 1/4 inch inside diameter by 1 7/8 inch outside diameter, or 2-braid blast hose 1 1/4 inch inside diameter by 2 3/32 inch outside diameter, or 4-ply blast hose 1 1/4 inch inside diameter by 2 3/32 inch outside diameter, or 4-ply blast hose 1 1/2 inch inside diameter by 2 3/8 inch outside diameter, and sufficient length to connect the second grit-resistant nozzle to the portable drum;

(r) the abrasive metering valve admits grit to said high pressure air to achieve a grit to air ratio of 1 to 10 LBS per 100 ASCF at 125 PSIG;

(s) the portable drum is an open-top 55-gallon drum of carbon steel;

(t) the lid for said portable drum has a first nozzle of diameter and configuration to attach the third hose and a second nozzle of diameter and configuration to attach the fourth hose;

(u) the portable dust collector has nominal capacity of 1,000 CFM at atmospheric pressure, with integral forced-draft fan, and outfitted with filter media with a MERV of at least 14; and (v) the fourth hose is flexible hose of nominal 6 inches in diameter, capable of withstanding slightly supra-atmospheric pressure, and of sufficient length to connect the portable drum to the portable dust collector.

10. The system in claim 5, wherein:

(a) the first ferromagnetic plate;

(1) is fabricated of a ferromagnetic material;

(2) is a rectangle with long side one-half to two-third the length of the longest face of the inlet non-ferromagnetic plate-type header and with short side one-half to two-third the length of the shortest face of the inlet non-ferromagnetic plate-type header;

(3) has a thicknesses of one-fourth inch to three-eighth inch;

(4) has two slots about one-half inch wide and three inches long with length-wise center-line parallel to the longest edge and centered between the two longest edges and positioned with the closest edge of each about six inches from its closest side;

(5) the slots each contain a t-handle on one side communicating with a compressible plug on the other side allowing said compressible plug to be expanded or contracted by rotation of the t-handle clockwise or counter-clockwise;

(6) is firmly but removably attached to the face of the inlet ferromagnetic plate-type header by expanding a first compressible plug into a tube and a second compressible plug into another tube;

(b) the second ferromagnetic plate;

(1) is fabricated of a ferromagnetic material;

(2) is a rectangle with long side one-half to two-third the length of the longest face of the outlet ferromagnetic plate-type header and with short side one-half to two-third the length of the shortest face of the outlet ferromagnetic plate-type header;

(3) has a thicknesses of one-fourth inch to three-eighth inch;

(4) has two slots about one-half inch wide and three inches long with length-wise center-line parallel to the longest edge and centered between the two longest edges and positioned with the closest edge of each about six inches from its closest side;

(5) the slots each contain a t-handle on one side communicating with a compressible plug on the other side allowing said compressible plug to be expanded or contracted by rotation of the t-handle clockwise or counter-clockwise;

(6) is firmly but removably attached to the face of the outlet ferromagnetic plate-type header by expanding a first compressible plug into a tube and a second compressible plug into another tube;

(c) the first device is firmly but removably attached to the face of the first ferromagnetic plate by the electromagnet energized by single phase nominal 120 VAC and having nominal attachment force of 750 to 800 pounds;

(d) the second device is firmly but removably attached to the face of the second ferromagnetic plate by the electromagnet energized by single phase nominal 120 VAC and having nominal attachment force of 750 to 800 pounds;

(e) the first power supply with battery back-up is energized by single phase nominal 120 VAC electrical power and has nominal capacity of 650 VA;

(f) the second power supply with battery back-up is energized by single phase nominal 120 VAC electrical power and has nominal capacity of 650 VA;

(g) the first device firmly but removably holds the first grit-resistant nozzle by a ring tightly clamped around a first nozzle holder and said first nozzle holder is supported by a saddle;

(h) the second device firmly but removably holds the second grit-resistant nozzle by a ring tightly clamped around a second nozzle holder and said second nozzle holder is supported by a saddle;

(i) the first grit-resistant nozzle is an abrasive blast nozzle with high velocity profile and orifice diameter ranging from 3/16 inch to ½ inch;

(j) the second grit-resistant nozzle is an abrasive blast nozzle with high velocity profile and orifice diameter ranging from 3/16 inch to ½ inch.

(k) the frame is a nozzle holder with ring tightly clamped around said nozzle holder and the nozzle holder supported by a saddle.

(l) the portable air compressor delivers high pressure air at a volumetric flow rate of 350 to 400 ACFM at a pressure of 100 to 150 PSIG;

(m) the grit chamber has a capacity of 6 to 6.5 Cu. Ft. and an operating pressure of at least 150 PSIG and is outfitted with an abrasive metering valve;

(n) the grit is garnet with a size range of 30 to 60 mesh and Mohs' hardness of 7.5 to 8;

(o) the first hose is industrial quality air hose with at least 250 PSIG maximum allowable working pressure and an inside diameter of at least 1 inch and of sufficient length to connect the portable air compressor and the grit chamber;

(p) the second hose is blast hose with at least 175 PSIG allowable working pressure, 1¼ inch inside diameter by 1⅞ inch outside diameter, or 2-braid blast hose 1¼ inch inside diameter by 2 3/32 inch outside diameter, or 4-ply blast hose 1¼ inch inside diameter by 2 3/32 inch outside diameter, or 4-ply blast hose 1½ inch inside diameter by 2⅜ inch outside diameter, and sufficient length to connect the grit chamber and the first grit-resistant nozzle;

(q) the third hose is blast hose with at least 175 PSIG allowable working pressure, 1¼ inch inside diameter by 1⅞ inch outside diameter, or 2-braid blast hose 1¼ inch inside diameter by 2 3/32 inch outside diameter, or 4-ply blast hose 1¼ inch inside diameter by 2 3/32 inch outside diameter, or 4-ply blast hose 1½ inch inside diameter by 2⅜ inch outside diameter, and sufficient length to connect the second grit-resistant nozzle to the portable drum;

(r) the abrasive metering valve admits grit to said high pressure air to achieve a grit to air ratio of 1 to 10 LBS per 100 ASCF at 125 PSIG;

(s) the portable drum is an open-top 55-gallon drum of carbon steel;

(t) the lid for said portable drum has a first nozzle of diameter and configuration to attach the third hose and a second nozzle of diameter and configuration to attach the fourth hose;

(u) the portable dust collector has nominal capacity of 1,000 CFM at atmospheric pressure, with integral forced-draft fan, and outfitted with filter media with a MERV of at least 14; and (v) the fourth hose is flexible hose of nominal 6 inches in diameter, capable of withstanding slightly supra-atmospheric pressure, and of sufficient length to connect the portable drum to the portable dust collector.

* * * * *